US005310306A

United States Patent [19]

Lunghi

[11] Patent Number: 5,310,306

[45] Date of Patent: May 10, 1994

[54] STACK LOADING APPARATUS AND METHOD

[76] Inventor: Donald G. Lunghi, 921 Park Ave., Burlingame, Calif. 94010

[21] Appl. No.: 792,707

[22] Filed: Nov. 15, 1991

[51] Int. Cl.[5] ..... B65H 9/10

[52] U.S. Cl. ..... 414/788; 414/788.9; 414/789.1; 414/795.7; 414/764; 414/907; 294/81.52

[58] Field of Search ..... 414/788, 788.4, 789.1, 414/790.2, 790.6, 795.7, 407, 764; 294/81.52; 271/221, 222

[56] References Cited

U.S. PATENT DOCUMENTS

| | | | |
|---|---|---|---|
| Re. 29,937 | 3/1979 | Mahaffy et al. | 53/511 |
| 795,514 | 7/1905 | Jewitt | 294/81.52 |
| 3,250,529 | 5/1966 | Eissfeldt | 271/221 |
| 3,392,853 | 7/1968 | Mitchell et al. | 414/790.6 |
| 3,893,665 | 7/1975 | Greene | 271/221 |
| 3,900,115 | 8/1975 | Kumagai | 271/222 |
| 4,466,606 | 8/1984 | Snellman et al. | 271/221 |
| 4,530,632 | 7/1985 | Sela | 414/788.9 |
| 4,592,692 | 6/1986 | Suizu et al. | 414/789.1 |
| 4,597,704 | 7/1986 | Vedvik et al. | 414/788 |
| 4,645,400 | 2/1987 | Mally et al. | 271/221 |
| 4,709,535 | 12/1987 | Mahaffy et al. | 53/473 |
| 4,919,414 | 4/1990 | Marschke et al. | 271/221 |

FOREIGN PATENT DOCUMENTS

| | | | |
|---|---|---|---|
| 2017375 | 4/1970 | Fed. Rep. of Germany | 414/907 |
| 2158559 | 6/1990 | Japan | 414/907 |
| 0683978 | 9/1979 | U.S.S.R. | 294/81.52 |

*Primary Examiner*—Michael S. Huppert
*Assistant Examiner*—Gregory A. Morse
*Attorney, Agent, or Firm*—Limbach & Limbach

[57] ABSTRACT

A stack loading apparatus for receiving and aligning a stack of similarly shaped sheet-like objects into a uniform stack having several elongate aligner actuators which are rotatably fixed to a base plate is disclosed. The base plate permits rotation of the aligner actuators about their longitudinal axes which are positioned perpendicular to the base plate. The aligner actuators are arranged on the base plate about a polygon perimeter corresponding in shape and size to the sheet-like object perimeter. Each aligner actuator has an aligner actuator track disposed on its outer surface. A movable guide plate is positioned substantially parallel to the base plate and includes several aligner actuator-receiving apertures which each have an inner perimeter having a ball bearing rotatably mounted therein for engaging the aligner actuator tracks. Elongate aligners are fastened to the aligner actuators. Supporting means are disposed on the guide plate substantially at the center of the aligner actuator polygon for supporting the stack of sheet-like objects in an orientation substantially parallel to the guide plate. Moving means moves the guide plate relative to the base plate along the aligner actuator longitudinal axis while maintaining a substantial parallel relationship between the guide plate and the base plate.

19 Claims, 6 Drawing Sheets

STACK LOADING APPARATUS AND METHOD

BACKGROUND OF THE INVENTION

1. Field of the Invention

The present invention relates generally to packaging systems, and more particularly, to a stack loading apparatus capable of receiving, aligning, and delivering a stack of sheet-like objects to a package.

2. Description of the Related Art

Pre-sliced luncheon meat, such as bologna, salami, and ham, is often packaged in pre-fabricated rigid plastic containers which conform to the shape of the meat slices. These plastic containers allow the consumer to remove a few slices of meat at one time while providing a convenient container for storage of the remaining slices.

At the processing plant, the meat is usually vacuum packed in the plastic containers to prevent spoilage during distribution. Vacuum packing causes the plastic containers to collapse a small amount and to surround the stacks of meat slices very tightly. In order for the containers to retain their shape after the package is opened and the vacuum is broken, there must be a low tolerance between the walls of the plastic container and the meat. The use of containers with low tolerance requires that the meat slices be accurately cut, stacked, and concentrically aligned so that the stack of meat slices will fit into the plastic container.

Luncheon meat is usually sliced by feeding long "logs" of meat into a slicing machine which produces unaligned stacks of slices. In certain automated meat-packaging facilities, the unaligned meat stacks exit from the slicing machine via an output conveyer belt. Assembly line workers then manually remove the unaligned stacks from the output conveyer belt and align each stack of meat slices with their fingers so that the stack will fit into the rigid plastic containers. The workers then press the stack into the containers by hand.

The use of assembly line workers to manually package stacks of meat slices has many disadvantages. Because the slicer machine conveyer belt moves continuously, the workers must align each stack of meat very quickly. This fast pace and the repetitive motion causes the work to be tedious. This can result in the stacks not being aligned in a uniform manner. Non-uniform stacks will not fit properly into the low tolerance containers.

The tedious nature of the work also creates a need for the workers to take several rest breaks during their work shift. The rest breaks are necessary because the stacking/packing work requires long periods of repetitive limited movements of the workers' muscles. The workers must have a few minutes to relax; otherwise, their muscles will become strained. These rest breaks slow production and reduce yield.

Other events also reduce yield. If a worker spends too much time aligning any one particular stack, the slicing machine may have to be stopped in order for the worker to "catch up." This also slows production and frustrates the worker.

Thus, there exists a need for an apparatus which can receive an unaligned stack of meat slices, align the stack, and deliver the stack to a container.

SUMMARY OF THE INVENTION

The present invention provides a stack loading apparatus for receiving and aligning a stack of similarly shaped sheet-like objects into a uniform stack. Several elongate aligner actuators are rotatably fixed to a base plate. The aligner actuators are positioned such that their longitudinal axes are perpendicular to the base plate. The aligner actuators are arranged on the base plate about the perimeter of a polygon corresponding to the perimeter of the sheet-like object to be stacked. Each aligner actuator has an aligner actuator track disposed on its outer surface, running substantially parallel to the actuator longitudinal axis.

A movable guide plate is positioned substantially parallel to the base plate. The guide plate includes several aligner actuator-receiving apertures which each have an inner perimeter sized for receiving the aligner actuators. Each aligner actuator-receiving aperture has a ball bearing rotatably mounted on its inner perimeter for engaging the aligner actuator tracks.

Elongate aligners are fastened to the aligner actuators. Each elongate aligner corresponds to one aligner actuator.

Supporting means are disposed on the guide plate substantially at the center of the aligner actuator polygon to support the stack of sheet-like objects in an orientation substantially parallel to the guide plate.

Moving means cause the guide plate to move relative to the base plate along the aligner actuators longitudinal axes. The moving means maintains a substantially parallel relationship between the guide plate and the base plate.

During operation, the moving means causes the guide plate to move relative to the base plate causing the bearings to interact with the tracks which causes the aligner actuators to rotate about their longitudinal axes. Rotation of the aligner actuators causes the aligners to contact and to act upon the stack of objects to obtain a uniform stack.

A better understanding of the features and advantages of the present invention will be obtained by reference to the following detailed description of the invention and accompanying drawings which set forth an illustrative embodiment in which the principals of the invention are utilized.

DETAILED DESCRIPTION OF THE PREFERRED EMBODIMENT

Figure 1:
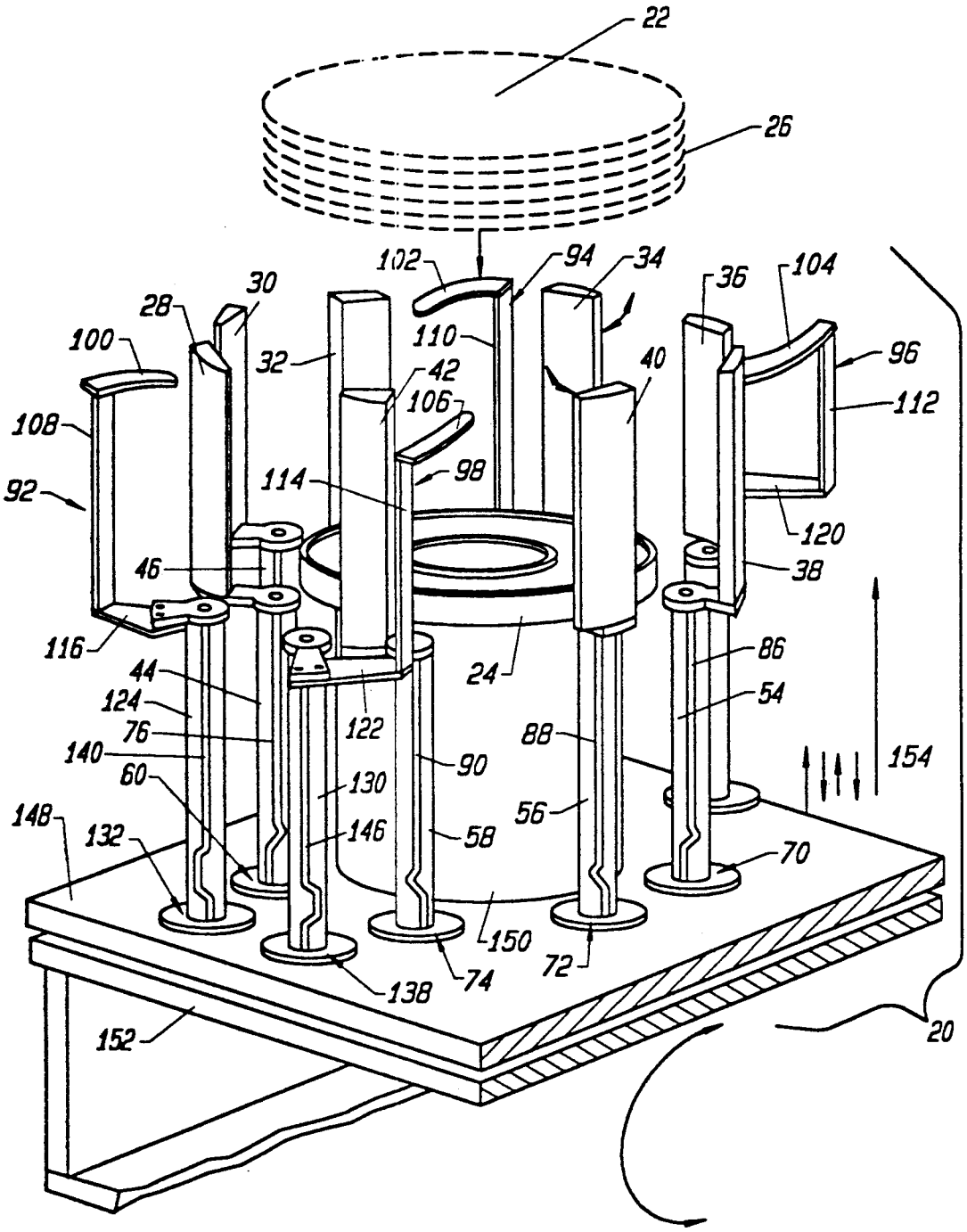
FIG. 1 is a perspective view of the gripper assembly of a preferred embodiment of the present invention.

The present invention is used to receive and align an initially unaligned stack of objects. The objects to be aligned are generally thin and sheet-like in nature. The planar surfaces of the objects are similarly shaped and their perimeter may form the shape of any polygon. Examples of stacks of objects which may be aligned using the teachings of the present invention are stacks of luncheon meat slices, decks of cards, stacks of poker chips, etc.

For stacks of luncheon meat, the stacks consist of from 2 to 100 slices, from 0.03"–0.5" thick per slice, in stacks of 0.25"–3" in height. Typical perimeter geometries are round, square, rectangular, and "D" shaped, varying in absolute dimension from 2.5"–5.5" diameter round, and from 2"×2"–5"×7" rectangular. These dimensions are typical, but by no means absolute. The figures illustrate an apparatus for handling 4.25" round product, which is simply the most common geometry encountered today.

An unaligned stack of objects is a stack whose individual objects are lying on top of each other in a disorderly and non-concentric manner. An unaligned stack cannot easily be inserted into a container having a shape which corresponds to the polygon of the individual objects; this is because the perimeter of an unaligned stack is usually larger than the perimeter of the individual objects. The apparatus of the present invention is designed to receive an unaligned stack, align the stack, and deliver the aligned stack to a container having a shape which corresponds to the polygon of the individual objects.

The apparatus of the present invention aligns the stack of objects by surrounding the perimeter of the stack with several spatulate elongate aligner members. They are positioned in close proximity to the stack in order to permit contact between the aligner members and the stack. The aligner members are also positioned perpendicular to the planar surface of each of the objects. The aligner members are reciprocatingly rotated back and forth about their longitudinal axes such that they make contact with the stack and cause a concentric uniform stack to form. As used herein, the term elongate means long and thin.

While the aligner members are rotating back and forth, the entire stack is elevated and lowered relative to the aligner members in a direction parallel to the longitudinal axis of the aligner members. The distance the stack is elevated and lowered is short, and the movements are quick. The several quick lowering movements tends to reduce the planar-directed friction forces between the individual objects which then makes the objects slide into alignment easier. These frictional forces are reduced even more if the stack is rotated into a stack-edge to earth orientation such that the planar surfaces of the objects are roughly parallel to the force of gravity.

The stack of objects normally rests on a supporting member during the alignment process. In addition to the aligners, the perimeter of the stack is surrounded by several finger members each having a finger retainer member. The finger retainer members selectively extend into and out of the interior of the stack perimeter, and they lie in a plane parallel to the objects' planar surface. When the finger retainer members are extended into the stack perimeter, the stack is encaged between the finger retainer members, the aligner members, and the supporting member. One purpose of encaging the stack is to keep light weight objects from being thrown from the apparatus while the stack is making upward and downward movements.

In order to deliver an aligned stack to a container, the stack and supporting member are preferably rotated about 180° (i.e., inverted) from the loading or accept position, and the stack quickly pushed into the container by the supporting member. The stack is quickly pushed into the container in order to insure that the stack remains concentric and uniform. Thus, another purpose of encaging the stack is to keep the aligned stack from falling out of the apparatus during rotation.

While the preferred embodiment of the present invention is used for receiving and aligning a stack of circular luncheon meat slices, virtually any type of objects having any shape may be aligned using the teachings of the present invention. Limitations of the invention are that the individual objects in the stack should be substantially planar (or "sheet-like") and substantially similarly shaped.

FIG. 1 illustrates a preferred embodiment of the gripper assembly 20 as used in meat packaging in accordance with the present invention. The purpose of the gripper assembly 20 is to receive and align an initially unaligned stack 22 of similarly shaped and substantially planar sheet-like objects. The gripper assembly 20 can align a stack of approximately four to forty circular objects having dimensions falling in the ranges of 3.5 to 5 inches in diameter and 0.25 to 2 inches in thickness. While the objects in the stack 22 shown in FIG. 1 have a circular perimeter, the gripper assembly 20 can be adapted to align a stack of objects having the shape of any polygon.

The stack 22 is supported by an elevator cap 24. The elevator cap 24 is a substantially planar piece of Ultra-High Molecular Density (UHMD) plastic preferably having a shape which corresponds roughly to the shape of the objects in the stack 22. UHMD polymers are a class of plastics, USDA approved, which are in broad general use in the food industry. assembly is preferably a type of plastic marketed under the trademark Delrin®. While its shape is similar to the objects in the stack 22, the elevator cap 24 has a smaller planar surface area than the objects in the stack 22. This allows the stack edges 26 to overhang the edges of the elevator cap 24. This overhang permits surrounding parts of the gripper assembly 20 to contact the stack edges 26. The elevator cap's 24 planar surface, which contacts the bottom slice of the stack 22, is partially recessed to reduce surface cohesion (sticking) between itself and the bottom slice. This eliminates disturbance of this slice when retracting the cap from the slice following the push.

Elongate aligners 28, 30, 32, 34, 36, 38, 40, and 42 are positioned about the perimeter of the stack 22. The aligners are the primary device used for aligning the stack 22. They should be arranged about the perimeter of a polygon which corresponds to the shape of the objects in the stack 22. While eight aligners are shown in FIG. 1, the number of aligners used will vary depending on the size and shape of the objects to be aligned.

The aligners have a spatulate shape and are positioned perpendicular to the planar surface of the objects in the stack 22. The aligners are in close proximity to the stack 22 so that rotation of the aligners causes their surface to come into contact with and act upon the stack edges 26. When the aligners make contact with the stack edges 26 the aligners push the individual objects into alignment creating a uniform and concentric stack. In the preferred embodiment, the aligners are constructed from UHMD plastic.

The aligners 28, 30, 32, 34, 36, 38, 40, and 42 are each supported by a corresponding cylindrical elongate aligner actuator 44, 46, 48, 50, 52, 54, 56, and 58, respectively. The function of the aligner actuators is to support and rotate the aligners. Each of the aligner actuators 44, 46, 48, 50, 52, 54, 56, and 58, is inserted into a corresponding aligner bearing assembly 60, 62, 64, 66, 68, 70, 72, and 74, respectively. Aligner actuator tracks 76, 78, 80, 82, 84, 86, 88, and 90 are disposed on the outer surface of each of the aligner actuators 44, 46, 48, 50, 52, 54, 56, and 58. The function of the aligner actuator tracks 76, 78, 80, 82, 84, 86, 88, and 90 is to engage with the aligner bearing assemblies 60, 62, 64, 66, 68, 70, 72, and 74 and cause the aligner actuators 44, 46, 48, 50, 52, 54, 56, and 58 to rotate about their longitudinal axes.

Fingers 92, 94, 96, and 98 are used to encage the stack 22 between the aligners 28, 30, 32, 34, 36, 38, 40, and 42 and the elevator cap 24. When the fingers are encaging the stack 22, they are said to be in "encaging position." The fingers 92, 94, 96, and 98 are positioned about the perimeter of the stack 22. The fingers 92, 94, 96, and 98 are positioned a slightly greater distance from the stack 22 than the aligners 28, 30, 32, 34, 36, 38, 40, and 42. Each of the fingers 92, 94, 96, and 98, is comprised of a finger retainer 100, 102, 104, and 106, a finger shaft 108, 110, 112, and 114, and a finger base 116, 118, 120, and 122. Four fingers are shown in FIG. 1; however, similar to the number of aligners, the number of fingers will depend on the size and shape of the objects in the stack 22.

The finger retainers 100, 102, 104, and 106 are flat, short pieces of metal which extend parallel to the planar surface of the stack 22. The finger retainers 100, 102, 104, and 106 are each attached to the finger shafts 108, 110, 112, and 114, which are positioned perpendicular to the planar surface of the stack 22. The other end of the finger shafts 108, 110, 112, and 114 are attached to the finger bases 116, 118, 120, and 122. The finger bases 116, 118, 120, and 122 are short, flat pieces of metal which are positioned parallel to the finger retainers 100, 102, 104, and 106.

The fingers 92, 94, 96, and 98 are each supported by a corresponding cylindrical elongate finger actuator 124, 126, 128, and 130, respectively. While the finger actuators 124, 126, 128, and 130 appear to be very similar to the aligner actuators 44, 46, 48, 50, 52, 54, 56, and 58, the finger actuators operate differently. The function of the finger actuators 124, 126, 128, and 130 is to support and rotate the fingers 92, 94, 96, and 98 into, and out of, encaging position. While the fingers 92, 94, 96, and 98 are in encaging position, the finger actuators 124, 126, 128, and 130 do not rotate; the aligner actuators 44, 46, 48, 50, 52, 54, 56, and 58, however, rotate while the fingers 92, 94, 96, and 98 are in encaging position.

Similar to the aligner actuators 44, 46, 48, 50, 52, 54, 56, and 58, each of the finger actuators 124, 126, 128, and 130 is inserted into a corresponding finger bearing assembly 132, 134, 136, and 138, respectively. Finger actuator tracks 140, 142, 144, and 146 are disposed on the outer surface of each of the finger actuators 124, 126, 128, and 130. The function of the finger actuator tracks 140, 142, 144, and 146 is to engage with the finger bearing assemblies 132, 134, 136, and 138 and cause the finger actuators 124, 126, 128, and 130 to rotate about their longitudinal axes.

All of the aligner bearing assemblies 60, 62, 64, 66, 68, 70, 72, and 74, and all of the finger bearing assemblies 132, 134, 136, and 138 are mounted on a substantially planar movable guide plate 148. The aligner bearing assemblies 60, 62, 64, 66, 68, 70, 72, and 74 are positioned on the guide plate 148 about the perimeter of a polygon corresponding to the shape of the objects in the stack 22. The finger bearing assemblies 132, 134, 136, and 138 are positioned on the guide plate 148 just outside the polygon formed by the aligner bearing assemblies 60, 62, 64, 66, 68, 70, 72, and 74.

The guide plate 148 supports an elevator shaft 150 which supports the elevator cap 24. The guide plate 148 is positioned parallel to a base plate 152. All of the aligner actuators 44, 46, 48, 50, 52, 54, 56, and 58, and all of the finger actuators 124, 126, 128, and 130, are rotatably mounted to the base plate 152 (mounting not shown in FIG. 1). The guide plate 148 is adapted so that it can move relative to the base plate 152 while remaining substantially parallel thereto.

The basic operation of the gripper assembly 20 can be described with reference to FIG. 1. An unaligned stack 22 is placed on the elevator cap 24. The guide plate 148 is then moved a first time relative to the base plate 152 in a direction of away from the base plate 152. In the preferred embodiment, this movement is caused by cooperation of a stepper motor with a screw located inside a cavity in the elevator shaft 150; the stepper motor and screw will be discussed below with reference to FIG. 10.

As the guide plate 148 moves up this first time, the finger bearing assemblies 132, 134, 136, and 138 engage with the finger actuator tracks 140, 142, 144, and 146. This engaging causes the finger actuators 124, 126, 128, and 130 to rotate about their longitudinal axes. Rotation of the finger actuators 124, 126, 128, and 130 causes the fingers 92, 94, 96, and 98 to rotate into encaging position. In other words, rotation of the fingers 92, 94, 96, and 98 causes the finger retainers 100, 102, 104, and 106 to extend above and into the perimeter of the stack 22. Extension of the finger retainers 100, 102, 104, and 106 causes the stack 22 to be encaged between the finger retainers 100, 102, 104, and 106, the elevator cap 24, and the aligners 28, 30, 32, 34, 36, 38, 40, and 42.

As the guide plate 148 continues to move up, the aligner bearing assemblies 60, 62, 64, 66, 68, 70, 72, and 74 engage with the aligner actuator tracks 76, 78, 80, 82, 84, 86, 88, and 90. This engaging causes the aligner actuators 44, 46, 48, 50, 52, 54, 56, and 58 to rotate about their longitudinal axes. Rotation of the aligner actuators 44, 46, 48, 50, 52, 54, 56, and 58 causes the aligners 28, 30, 32, 34, 36, 38, 40, and 42 to rotate. Because of their spatulate shape, rotation of the aligners 28, 30, 32, 34, 36, 38, 40, and 42 causes them to make contact with the stack edges 26. This contact creates forces that act in parallel to each object's planar surface. These forces cause the objects in the stack 22 to be pushed into alignment.

After the fingers 92, 94, 96, and 98 are in encaging position, the guide plate 148 makes several short up and down movements as indicated by the arrows 154. These short movements cause the aligners 28, 30, 32, 34, 36, 38, 40, and 42 to rotate back and forth so that they make contact with the stack edges 26 several times. The back and forth movement of the aligners 28, 30, 32, 34, 36, 38, 40, and 42 relative to the stack edges 26 aligns the stack 22.

Up and down movement of the guide plate 148 causes corresponding up and down movement of the elevator cap 24. Thus, the stack 22 is moving up and down while the aligners 28, 30, 32, 34, 36, 38, 40, and 42 contact the stack edges 26.

Figure 2:
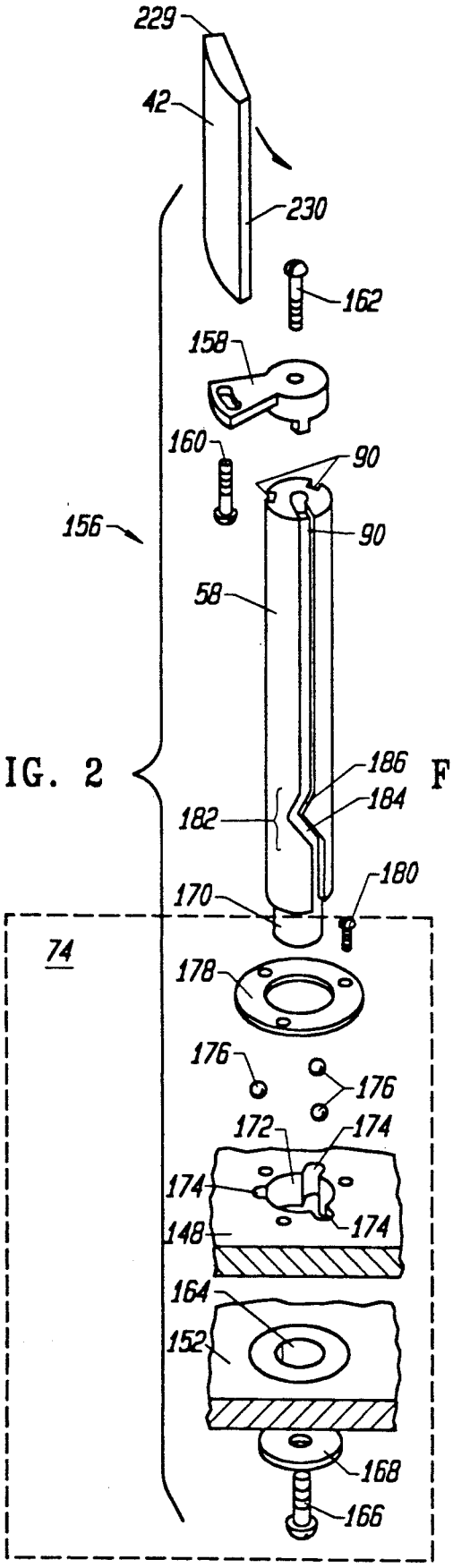
FIG. 2 is an exploded perspective view of an aligner assembly.
Figure 6:
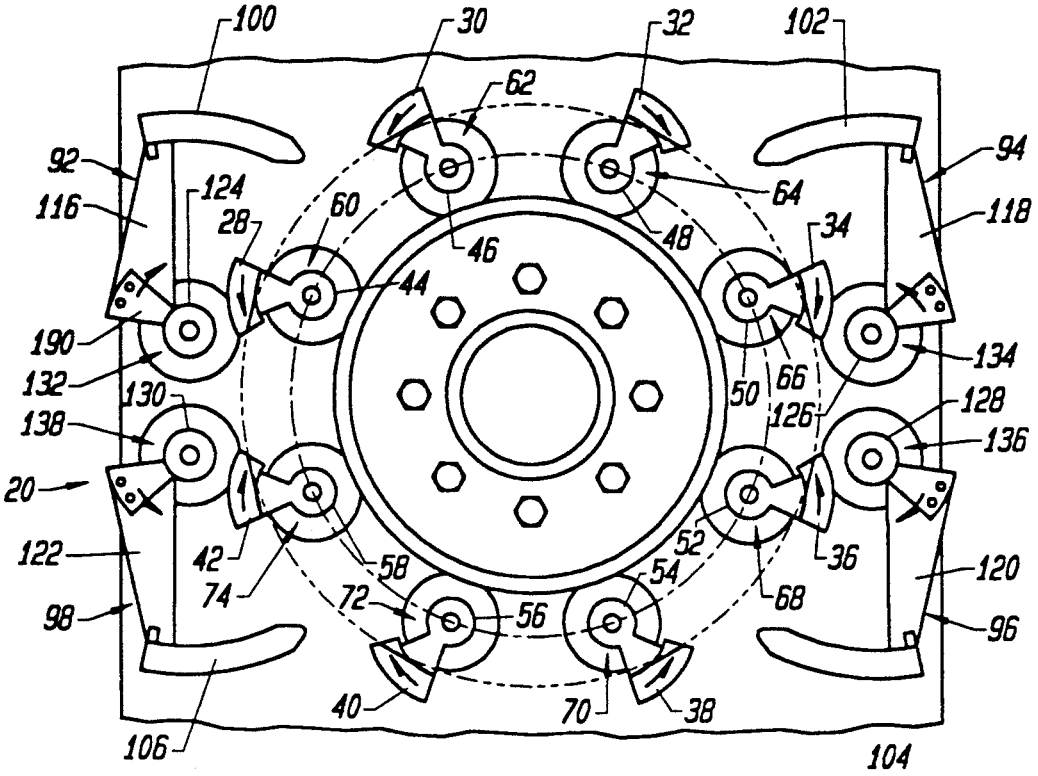
FIG. 6 is a top plan view of the gripper assembly in the accept position.

FIG. 2 illustrates one of the aligner assemblies 156 used in the gripper assembly 20. The aligner 42 is fastened to an aligner coupler 158 by an aligner screw 160. The aligner coupler 158 is used to fasten the aligner 42 to the aligner actuator 58. The aligner coupler 158 positions the longitudinal axis of the aligner 42 parallel to the longitudinal axis of the aligner actuator 58. While these two longitudinal axes are parallel, they are not collinear; rather, the longitudinal axis of the aligner 42 is slightly offset to one side of the longitudinal axis of the aligner actuator 58. This offset permits the aligner 42 to occupy a position out on a radius from the axis of the actuator 58. It is the dimension of this radius, in conjunction with the angle of rotation defined by the aligner actuator track 90 (90 degrees max) which define the stack accept radius (FIG. 6, outer section line radius) and the stack 22 deliver radius (FIG. 6, inner section line radius). An aligner coupler screw 162 fastens the aligner coupler 158 to the aligner actuator 58.

The aligner actuator 58 is inserted into the aligner bearing assembly 74. The aligner bearing assembly 74 causes the aligner actuator 58 to rotate when the guide plate 148 is moved relative to the base plate 152. The aligner actuator 58 is rotatably secured to the base plate 152 and passes through the guide plate 148. The aligner actuator 58 rotates because the bearing assembly 74 engages the aligner actuator tracks 90 as the guide plate 148 moves relative to the aligner actuator 58.

The aligner actuator 58 is rotatably secured in an aligner actuator mounting aperture 164 in the base plate 152 by means of an aligner actuator anchor screw 166 and an aligner actuator anchor washer 168. The end 170 of the aligner actuator 58 is tapered in order for it to fit into the aligner actuator mounting aperture 164. The aligner actuator anchor screw 166 and aligner actuator anchor washer 168 permit the aligner actuator 58 to rotate about its longitudinal axis.

The aligner actuator 58 extends through an aligner actuator receiving aperture 172 in the guide plate 148. The aligner actuator receiving aperture 172 is sized to allow easy rotation of the aligner actuator 58 therein. There are three aligner ball bearing mounting slots 174 in the perimeter of the aligner actuator receiving aperture 172, and three aligner ball bearings 176 are rotatably positioned in the slots 174. The aligner ball bearings 176 are held in place by an aligner actuator bearing washer 178 which covers the openings of the aligner ball bearing mounting slots 174. The aligner actuator bearing washer 178 is secured to the guide plate 148 by means of three aligner actuator bearing washer mounting screws 180.

The three aligner ball bearings 176 engage with the three aligner actuator tracks 90 which are disposed on the outer surface of the aligner actuator 58. Each of the aligner actuator tracks 90 is in substantial alignment with the longitudinal axis of the aligner actuator 58, except for a small aligner active track region 182 in each track. The interaction of the aligner ball bearings 176 with the aligner active track regions 182 causes the aligner actuator 58 to rotate.

The aligner active track regions 182 are small "V" shaped portions of the aligner actuator tracks 90. The half of the "V" shaped track at the lower end of the aligner actuator 58 is referred to as a first aligner active track region 184. The upper half of the "V" shaped track is referred to as a second aligner active track region 186.

As the guide plate 148 moves relative to the aligner actuator 58, the aligner ball bearings 176 follow the aligner actuator tracks 90. Because the position of the aligner ball bearings 176 about the perimeter of the aligner actuator receiving aperture 172 is fixed, when the aligner ball bearings 176 interact with the aligner active track regions 182 the only way for the aligner ball bearings 176 to follow the aligner actuator tracks 90 is for the aligner actuator 58 to rotate. Thus, as the guide plate 148 moves relative to the base plate 152, the aligner actuator 58 rotates about its longitudinal axis. This rotation is permitted by the rotatable mounting of the tapered end 170 of the aligner actuator 58 in the base plate 152.

The amount that the aligner actuator 58 rotates about its longitudinal axis can be controlled by controlling the distance that the guide plate 148 slides up the aligner actuator 58. If the guide plate 148 slides just past the beginning of the first aligner active track regions 184, the aligner actuator 58 will rotate only a small amount. This is because the aligner ball bearings 176 will interact with only the beginning of the first aligner active track regions 184. At the beginning of the first aligner active track regions 184 the aligner actuator tracks 90 deviate only a small amount from being parallel to the longitudinal axis of the aligner actuator 58. It follows that the aligner actuator 58 will rotate only a small amount.

As the guide plate 148, and thus the aligner ball bearings 176, are pushed farther into the first aligner active track regions 184, the aligner actuator 58 rotates more. This increased rotation is due to the middle and later parts of the first aligner active track regions 184 deviating more from the longitudinal axis of the aligner actuator 58 than the beginning part of the first aligner active track regions 184.

Optimum alignment of the stack 22 is achieved by causing the guide plate 148 to make several short up and down movements as indicated by the arrows 154 in FIG. 1. Each of the upward movements pushes the guide plate a little farther into the first aligner active track region 184. This causes the aligner actuator 58 to rotate a little more each time the guide plate 148 goes up. Thus, each time the aligner 42 makes contact with the stack edges 26 it is with a little more force.

The magnitude of the force with which the aligner 42 contacts the stack edges 26 starts small and gradually increases each time the aligner 42 makes contact. The gradually increasing force of the aligner 42 contributes to the uniform alignment of the stack 22. When the aligner 42 first makes contact with the stack edges 26, the stack 22 is most out of alignment. The aligner 42 initially makes only light contact on the stack edges 26 to align those objects in the stack 22 that are most out of alignment.

As the stack 22 becomes more aligned, the aligner 42 contacts the stack edges 26 with more force to perfect the alignment. Damage to the objects in the stack 22 could result if the aligner 42 initially contacted the stack edges 26 with too much force. This damage would be due to the objects in the stack 22 folding over rather than being aligned. For this reason, the aligner 42 makes a partial retreat of each inward motion just performed.

After the stack 22 has been aligned, the guide plate 148 will continue to move up along the aligner actuator 58 and into the second aligner active track region 186. The second aligner active track region 186 forms the second half of the "V" shape of the aligner active track region 182. While the first aligner active track region 184 deviated the aligner actuator track 90 from being parallel to the longitudinal axis of the aligner actuator 58, the second aligner active track region 186 returns the aligner actuator track 90 back to being parallel to the longitudinal axis of the aligner actuator 58.

When the aligner ball bearings 176 interact with the second aligner active track regions 186, the aligner actuator 58 rotates about its longitudinal axis in a direction opposite the direction it rotated while the guide plate 148 moved up through the first aligner active track regions 184. This rotation necessarily results because, in order for the aligner ball bearings 176 to stay in the aligner actuator tracks 90, the aligner actuator 58 must rotate.

The second aligner active track region 186 is shorter than the first aligner active track region 184. In other words, the upper half of the "V" shape in the aligner active track regions 186 are not as long as the lower half. Therefore, the portions of the aligner actuator tracks 90 that are below and above the aligner active track regions 182 (i.e., the portions that are parallel to the longitudinal axis of the aligner actuator 44) are not collinear to each other.

The shorter length of the second aligner active track region 186 means that the aligner 42 will not rotate back to the original position it occupied when the guide plate 148 was positioned at the beginning of the first aligner active track region 184. By not rotating back to its original position, the aligner 42 can stay in close proximity to the aligned stack 22 and hold it in alignment. Because an aligned stack will usually have a smaller diameter than an unaligned stack, the aligner 42 should not rotate back to its original position if it is to stay in close proximity with the stack edges 26.

Figure 3:
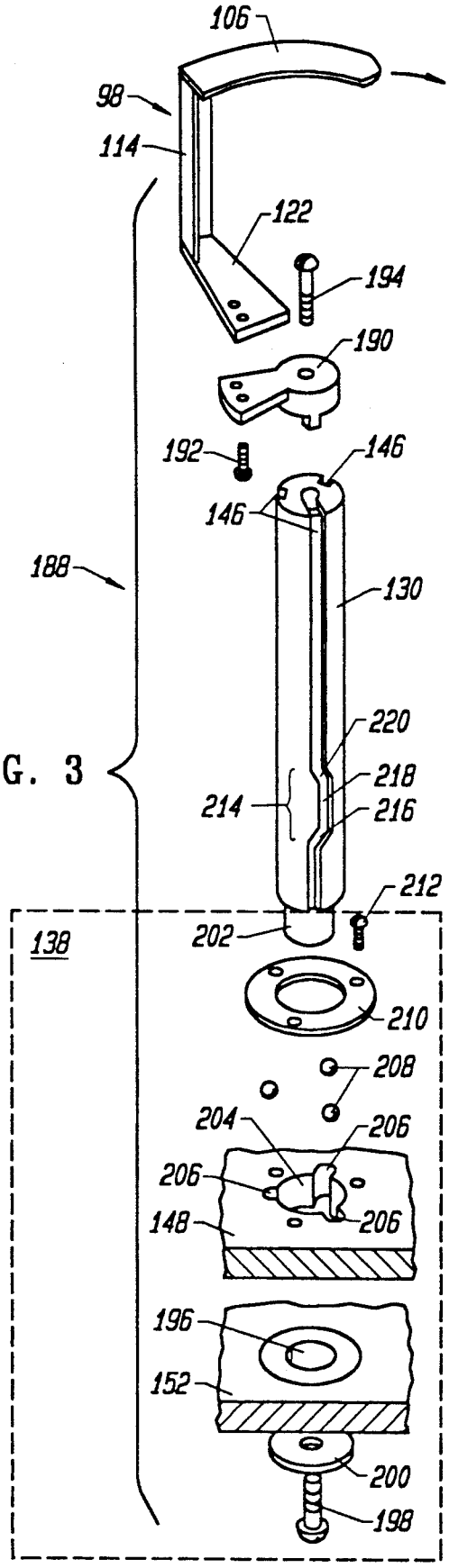
FIG. 3 is an exploded perspective view of a finger assembly.

FIG. 3 illustrates one of the finger assemblies 188 used in the gripper assembly 20. As stated above, the purpose of the fingers 92, 94, 96, and 98 is to encage the stack 22 between the finger retainers 100, 102, 104, and 106, the aligners 28, 30, 32, 34, 36, 38, 40, and 42, and the elevator cap 24. This encaging may be necessary because, as will be discussed below, if the gripper assembly 20 is inverted from its loading position in order to deliver the stack 22 to a container, the stack 22 must be initially restrained in the gripper assembly 20 to keep it from falling out prematurely.

The finger 98 includes a finger retainer 106, a finger shaft 114, and a finger base 122. The finger base 122 is fastened to a finger coupler 190 by means of a finger screw 192. The finger coupler 190 fastens the finger 98 to the finger actuator 130. Similar to the aligner coupler 158, the finger coupler 190, along with the finger base 122, positions the longitudinal axis of the finger shaft 114 parallel to the longitudinal axis of the finger actuator 130. Thus, during rotation of the finger actuator 130, the finger 98 rotates about the longitudinal axis of the finger actuator 130. The finger coupler 190 is fastened to the finger actuator 130 with a finger coupler screw 194.

The finger actuator 130 is rotatably mounted in a manner similar to the aligner actuator 58. The finger actuator 130 is inserted into the finger bearing assembly 138. The finger bearing assembly 138 causes the finger actuator 130 to rotate when the guide plate 148 is moved relative to the base plate 152. The finger actuator 130 is rotatably secured to the base plate 152 and passes through the guide plate 148. The finger actuator 130 rotates because the bearing assembly 138 engages the finger actuator tracks 146 as the guide plate 148 moves relative to the finger actuator 130.

The finger actuator 130 is rotatably secured in a finger actuator mounting aperture 196 in the base plate 152 using a finger actuator anchor screw 198 and a finger actuator anchor washer 200. The end 202 of the finger actuator 130 is tapered in order for it to fit into the finger actuator mounting aperture 196. The finger actuator anchor screw 198 and finger actuator anchor washer 200 permit the finger actuator 130 to rotate about its longitudinal axis.

The finger actuator 130 extends through a finger actuator receiving aperture 204 in the guide plate 148. The finger actuator receiving aperture 204 is sized to allow easy rotation of the finger actuator 130 therein. There are three finger ball bearing mounting slots 206 in the perimeter of the finger actuator receiving aperture 204, and three finger ball bearings 208 are rotatably positioned in the slots 206. The finger ball bearings 208 are held in place by a finger actuator bearing washer 210 which covers the openings of the finger ball bearing mounting slots 206. The finger actuator bearing washer 210 is secured to the guide plate 148 by means of three finger actuator bearing washer mounting screws 212.

The three finger ball bearings 208 interact with the three finger actuator tracks 146 disposed on the outer surface of the finger actuator 130. Each of the finger actuator tracks 146 is in substantial alignment with the longitudinal axis of the finger actuator 130, except for a small finger active track region 214. The interaction of the finger ball bearings 208 with the finger active track regions 214 causes the finger actuator 130 to rotate about its longitudinal axis.

The finger active track region 214 is shaped differently than the aligner active track region 182. This different shape permits the finger 98 to remain in encaging position while the aligner 42 reciprocatingly rotates back and forth about its longitudinal axis. Unlike the aligner active track region 182, the finger active track region 214 has three separate portions rather than two.

The first of the three separate portions of the finger active track region 214 is the first finger active track region 216. The first finger active track region 216 causes the finger 98 to snap into encaging position. The first finger active track region 216 causes the finger actuator track 140 to deviate a small amount from a position parallel to the longitudinal axis of the finger actuator 130.

The second portion of the finger active track region 214 is the short intermediate finger active track region 218 which follows the first finger active track region 216. The short intermediate finger active track region 218 maintains the finger 98 in encaging position while the aligner actuator 58 rotates about its longitudinal axis. The short intermediate finger active track region 218 is substantially parallel to the longitudinal axis of the aligner actuator 130.

The third portion of the finger active track region 214 is the second finger active track region 220 which follows the short intermediate finger active track region 218. The second finger active track region 220 causes the finger 98 to rotate out of encaging position. The second finger active track region 220, which ends the finger active track region 214, has substantially the same length as the first finger active track region 216. Unlike the aligner actuator track 90, the portions of the finger actuator track 146 that are below and above the finger active track region 214 are substantially collinear to each other.

After the stack 22 has been loaded onto the elevator cap 24, the guide plate 148 begins its first movement relative to the base plate 152. The guide plate 148 slides along the finger actuator 130 in the direction of its longitudinal axis. This first movement of the guide plate 148 causes the finger 98 to snap into encaging position.

The finger 98 is snapped into encaging position due to the interaction of the finger ball bearings 208 with the finger actuator tracks 146. Movement of the guide plate 148 past the first finger active track region 216 causes the finger ball bearings 208 to interact with the first finger active track regions 216. Because the position of the finger ball bearings 208 is fixed, the finger actuator 130 is caused to rotate about its longitudinal axis. Rotation of the finger actuator 130 causes the finger 98 to also rotate about the longitudinal axis of the finger actuator 130. This rotation snaps the finger retainer 106 into its encaging position by moving the finger retainer 106 over the stack 22.

The other fingers 92, 94, and 96 (see FIG. 1) snap into encaging position at the same time as finger 98. When in encaging position, all of the finger retainers 100, 102, 104, and 106 extend above and into the polygon perimeter of the objects contained in the stack 22. The result is that the stack 22 is encaged between the finger retainers 100, 102, 104, and 106, the aligners 28, 30, 32, 34, 36, 38, 40, and 42, and the elevator cap 24.

After moving past the first finger active track region 216, the finger ball bearings 208 interact with the short intermediate finger active track region 218. The finger 98 remains in encaging position while the finger ball bearings 208 interact with the short intermediate finger active track region 218.

The finger 98 remains in encaging position because the short intermediate finger active track region 218 is substantially parallel to the longitudinal axis of the finger actuator 130. When the finger ball bearing 208 is in a portion of the finger actuator track 146 that is parallel to the longitudinal axis of the finger actuator 130, the finger actuator 130 does not rotate. Rather, the finger actuator 130 remains in the position it was in at the end of the first finger active track region 216. Thus, the finger 98 remains in encaging position while the guide plate 148 is positioned such that the finger ball bearings 208 interact with the short intermediate finger active track region 218.

After the first upward movement, the guide plate 148 makes several short up and down movements as indicated by the arrows 154 in FIG. 1. The distance that the guide plate 148 travels in these up and down movements is small enough such that the finger ball bearings 208 remain in the short intermediate finger active track region 218, which keeps the finger 98 in encaging position. While the finger ball bearings 208 are in the short intermediate finger active track region 218, the aligner ball bearings 176 (see FIG. 2) are interacting with the first aligner active track region 184. As a result, while the finger 98 is in encaging position, the aligner 42 is rotating and making contact with the stack edges 26.

In the preferred embodiment, the movement of the guide plate 148 is caused by cooperation of a stepper motor with a screw located inside a threaded cavity in the elevator shaft 150. As will be discussed more completely below with reference to FIG. 10, a stepper motor is mounted beneath the base plate 152 with the stepper motor shaft extending through the base plate 152. A screw is collinearly connected to the stepper motor shaft and the screw extends into a threaded cavity in the elevator shaft 150.

Rotation of the stepper motor shaft causes the screw to move into the elevator shaft 150 or to move out of the elevator shaft 150. Rotation of the screw in either direction will move the elevator shaft 150 relative to the stepper motor. Since the elevator shaft 150 is mounted to the guide plate 148, and the stepper motor is mounted to the base plate 152, movement of the elevator shaft 150 relative to stepper motor moves the guide plate 148 relative to the base plate 152.

If the stepper motor turns its shaft in a direction such that the screw moves out of the elevator shaft 150, the guide plate 148 will move up (i.e., away from the base plate 152). If the stepper motor turns its shaft such that the screw moves into the elevator shaft 150, the guide plate 148 will move down (i.e., towards the base plate 152). The short up and down movements of the guide plate 148 can be controlled by having the stepper motor rotate its shaft only a small amount in one direction, and then rotate its shaft a corresponding amount in the other direction. These small back and forth rotations of the stepper motor shaft will cause the screw to move short distances into and out of the elevator shaft 150.

The stepper motor causes the guide plate 148 to make its first move upward by rotating its shaft in a direction such that the screw moves out of the elevator shaft 150. On this first movement of the guide plate 148, the screw is rotated the appropriate number of turns to position the guide plate 148 such that the finger ball bearings 208 interact with the short intermediate finger active track region 218. Once the finger ball bearings 208 are in the short intermediate finger active track region 218, the stepper motor begins the short back and forth rotations of its shaft. The back and forth rotations of the stepper motor shaft are short enough such that the finger ball bearings 208 interact only with the short intermediate finger active track region 218. The finger 98 remains in encaging position, while the finger ball bearings 208 interact with the short intermediate finger active track region 218.

In another embodiment, the aligners 28, 30, 32, 34, 36, 38, 40, and 42 and the fingers 92, 94, 96, and 98 are rotated by coupling an individual stepper motor to each aligner actuator 44, 46, 48, 50, 52, 54, 56, and 58 and to each finger actuator 124, 126, 128, and 130. In this embodiment the movable guide plate 148, elevator shaft 150, aligner bearing assemblies 60, 62, 64, 66, 68, 70, 72, and 74, finger bearing assemblies 132, 134, 136, and 138, aligner actuator tracks 76, 78, 80, 82, 84, 86, 88, and 90, and finger actuator tracks 140, 142, 144, and 146 are no longer necessary. The disadvantages of this embodiment are torque and electronic complexity.

In yet another embodiment, the aligners 28, 30, 32, 34, 36, 38, 40, and 42 are rotated by coupling the aligner actuators 44, 46, 48, 50, 52, 54, 56, and 58 to a motor via a watch-like gearing mechanism. A similar mechanism would couple the finger actuators 124, 126, 128, and 130 to the motor.

After several back and forth reciprocating rotations of the aligner 42 (which are caused by the short up and down movements of the guide plate 148), the stack 22 will usually be aligned into a uniform, concentric stack. When the stack 22 is aligned, the guide plate 148 starts the last upward movement of the cycle.

The last upward movement of the guide plate 148 causes the aligner ball bearings 176 to interact with the end of the first aligner active track region 184. Interaction of the aligner ball bearings 176 with the end of the first aligner active track region 184 causes the aligner actuator 58 to rotate to a point of maximum rotation. Maximum rotation of the aligner actuator 58 causes the aligner 42 to contact the stack edges 26 with its maximum force, i.e., a force greater than the force of previous contacts.

Immediately after the aligner 42 contacts the stack edges with maximum force, the guide plate 148 continues the last upward movement causing the aligner 42 to rotate away from the stack edges 26 a very small amount. This reverse rotation is caused by the aligner ball bearings 176 interacting with the second aligner active track region 186. Interaction of the aligner ball bearings 176 with the second aligner active track region 186 causes the aligner actuator 58 to rotate in a direction opposite the direction it rotated while the aligner ball bearings 176 interacted with the first aligner active track regions 184.

Rotation of the aligner actuator 58 in this direction causes the aligner 42 to rotate away from the stack edges 26. Because the second aligner active track region 186 is shorter than the first aligner active track region 184, the aligner 42 does not rotate back to the position it occupied while the gripper assembly 20 was in the accept position; rather, the aligner 42 makes a much shorter rotation. The amount of rotation is large enough such that the aligner 42 is not contacting the stack edges 26 with maximum force, but the rotation is small enough such that the aligner 42 may still be contacting the stack edges 26. When in this position, the aligners 44, 46, 48, 50, 52, 54, 56, and 58 form a perimeter having a size falling between the nominal perimeter of the stack 22 and the nominal perimeter of the container. In other words, on completion of their rotation, the aligners 44, 46, 48, 50, 52, 54, 56, and 58 hold the stack 22 so that its perimeter is concentric to, and within the perimeter of, the empty container.

Immediately after the aligner ball bearings 176 interact with the second aligner active track region 186 the guide plate 148 stops its upward movement for a short period. While the guide plate 148 is stopped, the aligner ball bearings 176 rest in the linear portion of the aligner actuator track 90 next to the second aligner active track region 186. The aligner 42 remains in a position where it is in contact with the stack edges 26. Furthermore, the finger ball bearings 208 are resting in a position near the end of the short intermediate finger active track region 218. Thus, the finger 98 remains in encaging position during the period that the guide plate 148 is stopped.

During the period that the guide plate 148 is stopped, all of the fingers 92, 94, 96, and 98 remain in encaging position. Furthermore, all of the aligners 28, 30, 32, 34, 36, 38, 40, and 42 are held in contact with the stack edges 26. Thus, the stack 22 is secured in the gripper assembly 20 in a manner that will not permit the alignment of the stack 22 to be easily disturbed.

As will be discussed below with reference to FIG. 10, if the gripper assembly 20 is used to deliver the stack 22 to a container, it is preferred to rotate the gripper assembly about 180° about a rotation axis. This rotation axis is positioned parallel to the base plate 152 on a side opposite the guide plate 148, and the rotation axis is positioned perpendicular to a second axis which passes through the center of the stack 22 and is parallel to the aligners 28, 30, 32, 34, 36, 38, 40, and 42.

It is preferred to rotate the gripper assembly 180° about the rotation axis because then the stack 22 can be pressed into the container quickly which will help preserve the stack's 22 alignment. The stack 22 is pressed into the container by the continuation of the last upward movement of the guide plate 148. This last movement of the guide plate 148 moves the elevator shaft 150 which causes the elevator cap 24 to push the stack 22 into the container.

The gripper assembly 20 is rotated 180° during the period that the guide plate 148 is stopped during its last upward movement. Because the stack 22 is secured in the gripper assembly 20 during this stopped period, the alignment of the stack 22 will not be disturbed while the gripper assembly 20 rotates 180°. Furthermore, the stack 22 will not fall out of the gripper assembly 20 before it is to be pushed into the container.

The last step of the cycle that the gripper assembly 20 goes through when aligning the stack 22 is to release the stack 22 from the gripper assembly 20 after the stack 22 is aligned. When the stack 22 is to be released, the guide plate 148 starts moving again and continues the last upward movement. The continuation of the last upward movement causes the stack 22 to be released by rotating the finger 98 out of encaging position. The aligner 42, however, remains in contact with the stack 22.

The finger 98 is rotated out of encaging position by the finger ball bearings 208 interacting with the second finger active track regions 220. The last upward movement of the guide plate 148 causes the finger ball bearings 208 to interact with the second finger active track regions 220. Interaction of the finger ball bearings 208 with the second finger active track region 220 causes the finger actuator 130 to rotate in a direction opposite the direction it rotated when the finger ball bearings 208 interacted with the first finger active track region 216. Rotation of the finger actuator 130 in this direction causes the finger 98 to rotate away from the stack 22. This rotation of the finger 98 causes the finger retainer 106 to move out of the interior of the polygon perimeter formed by the objects in the stack 22. When the finger ball bearings 208 are completely past the second finger active track regions 220, the finger retainer 106 is withdrawn to the exterior of the polygon perimeter formed by the objects in the stack 22 and is completely removed from the encaging position.

As the guide plate 148 comes to the end of the last upward movement of the cycle, it reaches the top of the aligner actuator 58 and the top of the finger actuator 130. Because the aligner actuator 44 and the finger actuator 130 are secured to the base plate 152, the guide plate 148 moves relative to the aligner 42 and the finger 98. Because the elevator cap 24 is coupled to the guide plate 148 via the elevator shaft 150, the elevator cap 24 also moves relative to the aligner 42 and the finger 98. Thus, the stack 22, which rests on the elevator cap 24, is elevated above the aligner 42 and the finger 98 which releases it from the gripper assembly 20.

In a particularly preferred embodiment, protective rubber covers are placed over the aligner actuators 44, 46, 48, 50, 52, 54, 56, and 58 and the finger actuators 124, 126, 128, and 130. These rubber covers are accordion shaped and prevent the actuators from fouling with grease, dirt, and meat. It is particularly important to keep the aligner actuator tracks 76, 78, 80, 82, 84, 86, 88, and 90 and the finger actuator tracks 140, 142, 144, and 146 free from grease, dirt, and meat because the aligner ball bearings 176 and the finger ball bearings 208 must be permitted to interact freely with the tracks. A rubber material used for rubber gloves makes a suitable actuator cover.

When the gripper assembly 20 is used to receive, align, and deliver the stack 22 to a rigid plastic container, the gripper assembly 20 is normally used in conjunction with a packaging station which delivers an unaligned stack of objects to the gripper assembly 20 and which positions an empty container in position for receiving an aligned stack of objects from the gripper assembly 20. In this particularly preferred embodiment, the stack 22 is delivered to the gripper assembly 20 while it is in the "accept position" (i.e., up position). The gripper assembly 20 is then operated through an "alignment and deliver cycle" having several steps. The gripper assembly 20 delivers the stack 22 to a container during the "press to container step" of the cycle. During this step the gripper assembly 20 is in a down position (i.e., inverted position).

Figure 4:
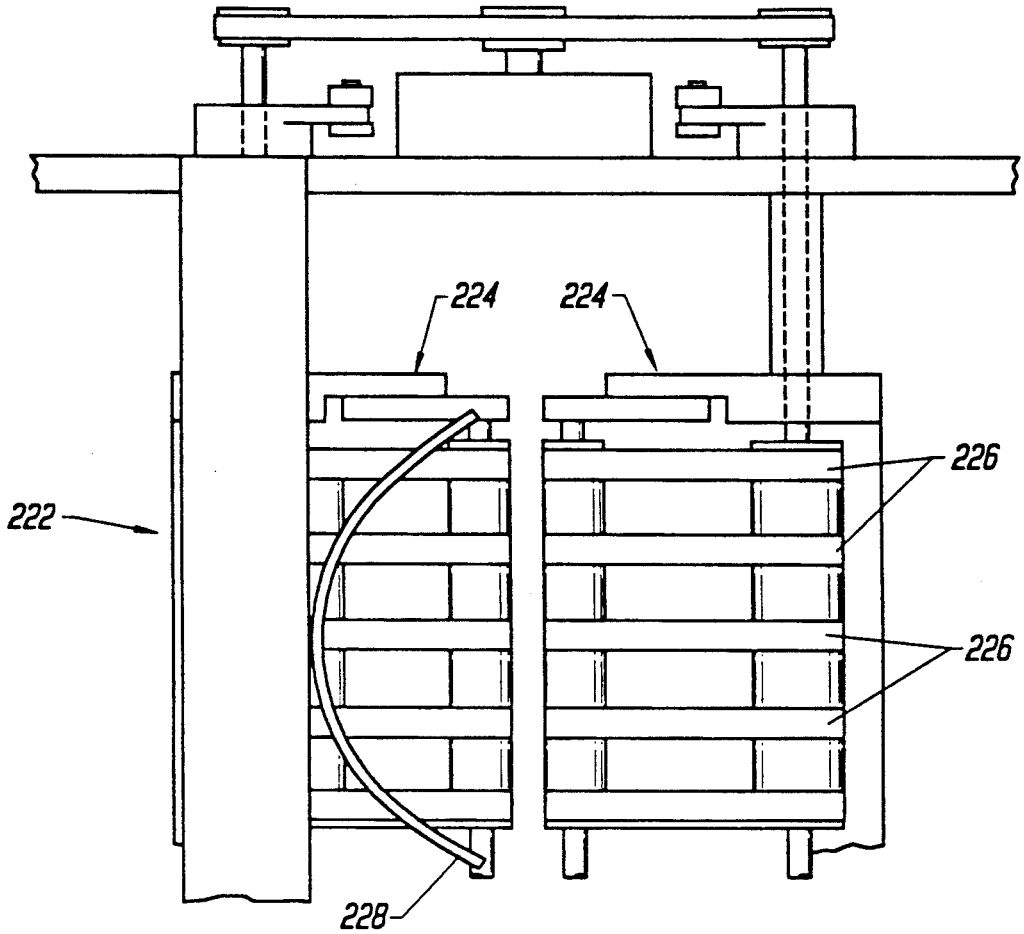
FIG. 4 is a top plan view of a set of bomb bay conveyers.

FIG. 4 illustrates a bomb bay assembly 222 of a packaging station used to deliver the stack 22 to the gripper assembly 20. A slicing machine output conveyer belt carries an unaligned stack of meat slices 22, e.g., bologna, salami, or pepperoni, to the bomb bay assembly 222 and positions the unaligned stack 22 on two bomb bay conveyers 224. The bomb bay conveyers 224 have several small conveyer belts 226 which assist in positioning the stack 22 against a bomb bay backstop 228. The bomb bay backstop 228 has a shape similar to about one-half the perimeter of the meat slices in the stack 22 and holds the stack 22 in a single position on the bomb bay conveyers 224 above the location of the gripper assembly 20 so that the stack 22 can be accurately delivered to the gripper assembly 20.

Figure 5:
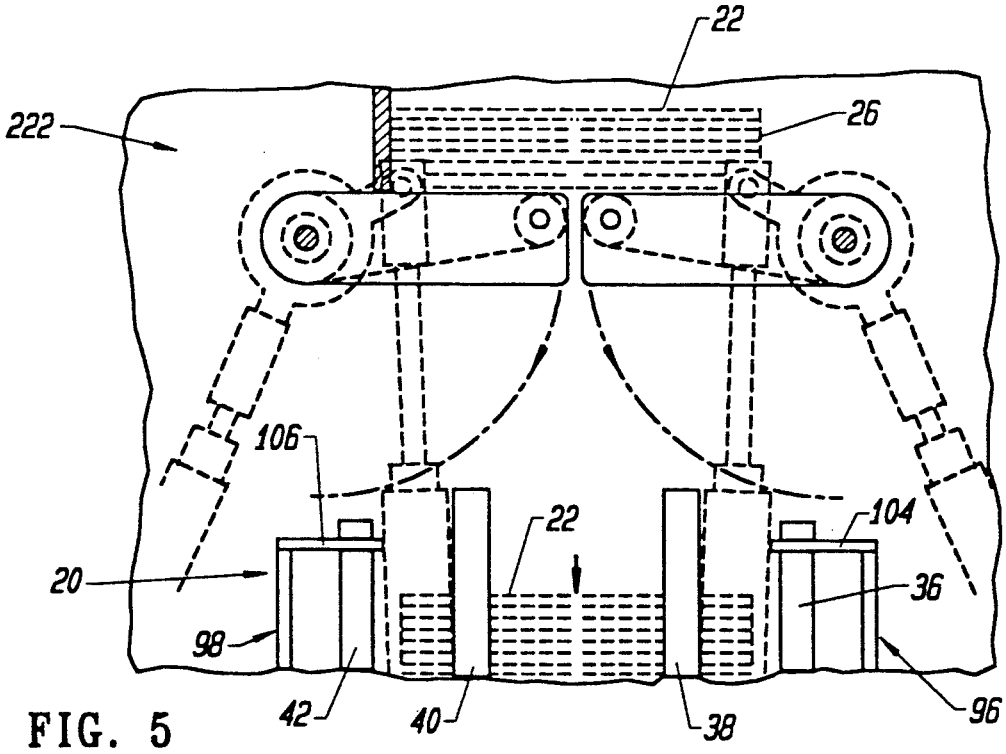
FIG. 5 is a side view of the bomb bay conveyors of FIG. 4.

FIG. 5 is a side view of the bomb bay assembly 222 and illustrates the gripper assembly 20 receiving the stack 22. When the gripper assembly 20, is ready to receive an unaligned stack 22, the bomb bay conveyers 224 open downward and drop the stack 22 into the gripper assembly 20. The gripper assembly 20 is ready to receive an unaligned stack when it is in the "accept position".

FIG. 6 illustrates the gripper assembly 20 in the accept position. In the accept position the guide plate 148 is all the way down (i.e., against the base plate 152). When the guide plate 148 is in this position the aligners 28, 30, 32, 34, 36, 38, 40, and 42 are fully withdrawn from the perimeter of the polygon which corresponds to the shape of the objects contained in the stack 22. Furthermore, the finger retainers 100, 102, 104, and 106 are withdrawn from the interior of the polygon which corresponds to the shape of the objects contained in the stack 22. Therefore, the unaligned stack 22 can be easily dropped from the bomb bay conveyers 224 onto the elevator cap 24 without interference from the aligners 28, 30, 32, 34, 36, 38, 40, and 42 or the finger retainers 100, 102, 104, and 106.

After the unaligned stack 22 has been dropped onto the elevator cap 24, the gripper assembly 20 is operated through the "alignment and deliver cycle." In order to describe the alignment and deliver cycle, reference will be made to the finger assembly 188 as representative of the operation of all four finger 92, 94, 96, and 98, finger actuator 124, 126, 128, and 130, and finger bearing assembly 132, 134, 136, and 138 combinations. The operation of all four fingers 92, 94, 96, and 98 is identical, except for one minor difference. When rotating into encaging position, fingers 92 and 96 rotate clockwise and fingers 94 and 98 rotate counterclockwise, and when rotating out of encaging position, fingers 92 and 96 rotate counterclockwise and fingers 94 and 98 rotate clockwise. The differences in the direction of rotation is due to the active regions of the finger actuator tracks 140 and 144 being the mirror image shape of the active regions of the finger actuator tracks 142 and 146.

Similarly, reference will be made to the aligner assembly 156 as representative of the operation of all of the aligner 28, 30, 32, 34, 36, 38, 40, and 42, aligner actuator 44, 46, 48, 50, 52, 54, 56, and 58, and aligner bearing assembly 60, 62, 64, 66, 68, 70, 72, and 74 combinations. The operation of all eight aligners 28, 30, 32, 34, 36, 38, 40, and 42 is identical, except that when rotating to make contact with the stack edges 26, aligners 32, 34, 40, and 42 rotate clockwise and aligners 28, 30, 36, and 38 rotate counterclockwise. Again, the differences in the direction of rotation is due to the active regions of aligner actuator tracks 80, 82, 88, and 90 being the mirror image shape of the active regions of aligner actuator tracks 76, 78, 84, and 86.

Figure 7:
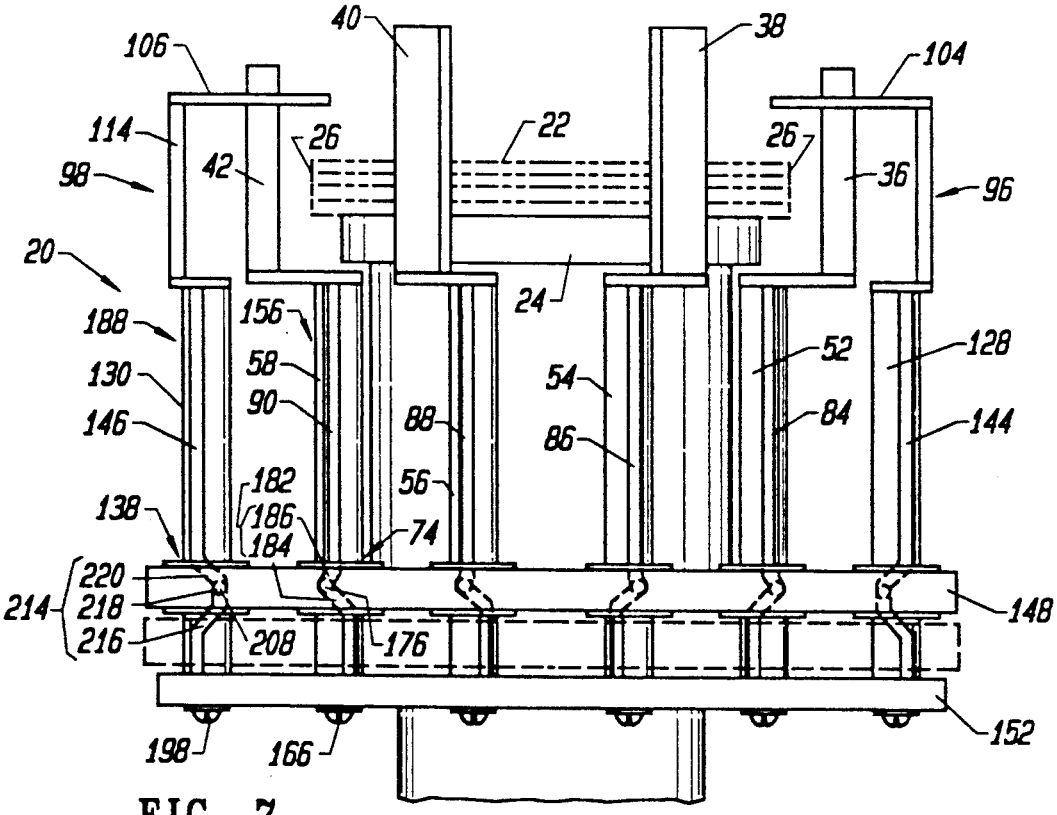
FIG. 7 is a side elevation view of the gripper assembly encaging a stack of objects.

The first step in the alignment and deliver cycle is the "grasp and constrain" step in which the guide plate 148 starts its first upward movement relative to the base plate 152, as illustrated by FIG. 7. In the grasp and constrain step the finger ball bearings 208 interact with the finger active track region 214 of the finger actuator tracks 146. This interaction snaps the finger retainer 106 into its encaging position, as described above.

When in encaging position, all of the finger retainers 100, 102, 104, and 106 extend above and into the interior of the polygon which corresponds to the shape of the objects contained in the stack 22. The extension of the finger retainers 100, 102, 104, and 106 causes the stack 22 to be encaged between the finger retainers 100, 102, 104, and 106, the aligners 28, 30, 32, 34, 36, 38, 40, and 42, and the elevator cap 24.

The aligners also rotate for the first time during the grasp and constrain step. As the guide plate 148 moves upward, the aligner ball bearings 176 interact with the aligner active track region 182 of the aligner actuator tracks 90. This interaction causes the aligners 28, 30, 32, 34, 36, 38, 40, and 42 to rotate and make contact with the stack edges 26 for the first time.

Figure 8:
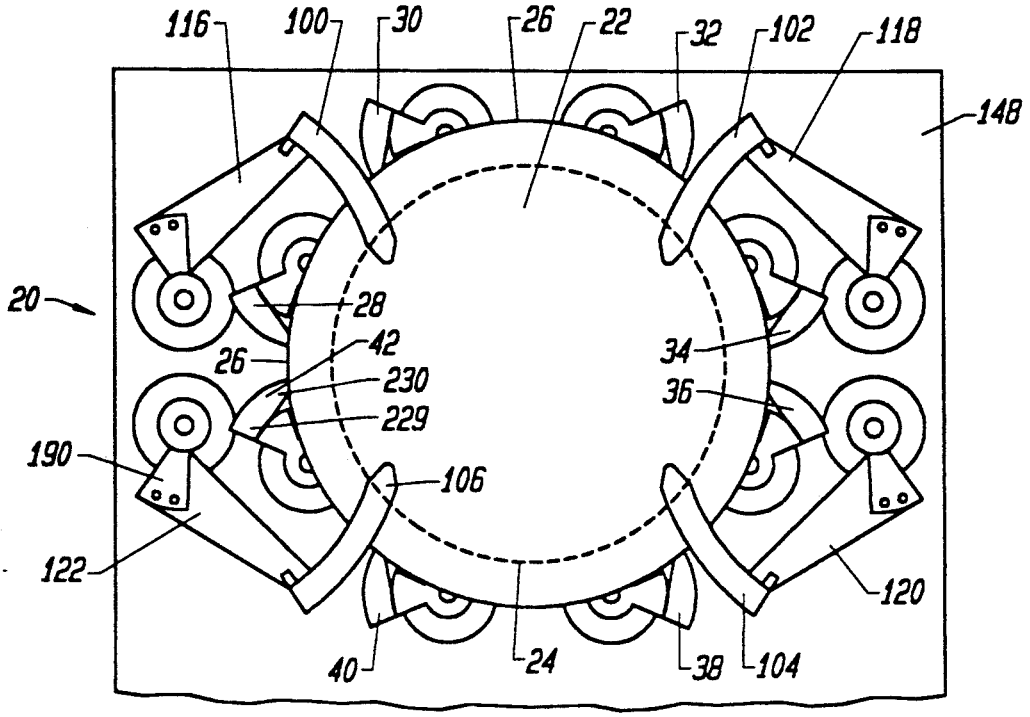
FIG. 8 is a top plan view of the gripper assembly encaging a stack of objects.

FIG. 8 illustrates the stack 22 in the gripper assembly 20 just subsequent to the grasp and constrain step. The finger actuators 124, 126, 128, and 130 are rotated such that the finger retainers 100, 102, 104, and 106 extend above the stack 22 and into the interior of the perimeter of the polygon which corresponds to the perimeter of the objects contained in the stack 22. The aligner actuators 44, 46, 48, 50, 52, 54, 56, and 58 are rotated such that the aligners 28, 30, 32, 34, 36, 38, 40, and 42 make contact with the perimeter of the polygon which corresponds to the perimeter of the objects contained in the stack 22. In other words, the aligners 28, 30, 32, 34, 36, 38, 40, and 42 are in contact with the stack edges 26.

In this preferred embodiment, the polygon which corresponds to the perimeter of the stack 22 is a circle. FIG. 8 illustrates that the aligner bearing assemblies 60, 62, 64, 66, 68, 70, 72, and 74 are arranged on the guide plate 148 about the polygon perimeter corresponding to the perimeter of the objects in the stack 22, namely, a circle. The aligner actuators 44, 46, 48, 50, 52, 54, 56, and 58 are arranged on the base plate 152 about the polygon perimeter corresponding to the perimeter of the objects in the stack 22. The finger actuators 124, 126, 128, and 130 are arranged on the base plate 152 at least as far from the center of the polygon as the aligner actuators 44, 46, 48, 50, 52, 54, 56, and 58. The finger retainer members 100, 102, 104, and 106 are adapted to selectively extend into, and out of, the interior of the polygon defined by the aligner actuators 44, 46, 48, 50, 52, 54, 56, and 58.

While the polygon corresponding to the perimeter of the objects in the stack 22 is a circle, it should be understood that the gripper assembly 20 can be modified to receive, align, and deliver a stack having the perimeter of any polygon. For example, the objects or meat slices in the stack 22 could be rectangular, triangular, diamond shape, etc. The modifications to the gripper assembly 20 of the preferred embodiment to accommodate an object of a different shape would include arranging the aligner actuators 44, 46, 48, 50, 52, 54, 56, and 58 on the base plate 152 about a polygon perimeter corresponding to the perimeter of the object perimeter, e.g., rectangle, triangle, diamond, circle, etc. The aligners 28, 30, 32, 34, 36, 38, 40, and 42 would also be modified such that, when rotated, they make contact with the polygon perimeter.

Another modification to the preferred gripper assembly 20 in order to enable it to receive, align, and deliver a stack of objects having a perimeter corresponding to a different polygon would be to arrange the finger actuators 124, 126, 128, and 130 on the base plate 152 at least as far from the center of the polygon as the aligner actuators 44, 46, 48, 50, 52, 54, 56, and 58. The fingers 92, 94, 96, and 98 would then be fastened to the finger actuators 124, 126, 128, and 130 such that the finger retainers 100, 102, 104, and 106 lie in a plane parallel to the base plate 152 and perpendicular to the finger shafts 108, 110, 112, and 114. The finger retainers 100, 102, 104, and 106 would be adapted to selectively extend into, and out of, the interior of the polygon perimeter corresponding to the perimeter of the objects in the stack and defined by the aligner actuators 44, 46, 48, 50, 52, 54, 56, and 58.

While the gripper assembly 20 uses eight aligners 28, 30, 32, 34, 36, 38, 40, and 42 and four fingers 92, 94, 96, and 98, when making the above modifications it may be desirable to use a different number of aligners and/or fingers. The number of aligners and fingers used will depend on the size and shape of the stack of objects to be aligned.

After the grasp and constrain step, the gripper assembly 20 begins a "shuffle step" in which most of the aligning of the stack 22 is completed. During the shuffle step, the guide plate 148 makes several short up and down movements, as described above. These short up and down movements cause the aligners 28, 30, 32, 34, 36, 38, 40, and 42 to make contact with the stack edges 26 (i.e., the perimeter of the objects in the stack 22) several times while the finger retainers 100, 102, 104, and 106 remain in the encaging position. The guide plate 148 travels slightly farther on each upward movement in this series of reciprocating motions which causes the aligners 28, 30, 32, 34, 36, 38, 40, and 42 to contact the stack edges 26 with a little more force each time they rotate against the stack 22 perimeter.

The aligners 28, 30, 32, 34, 36, 38, 40, and 42 have a spatulate shape. Using aligner 42 as illustrated in FIGS. 2 and 8 as an example, it has a thick edge 229 and a narrow edge 230. The thick edge 229, which is connected to the aligner coupler 158 via the aligner screw 160, maintains rigidity in the direction of the alignment force and action. The narrow edge 230 makes contact with the stack 22 perimeter and maintains the line of the desired stack edge while flexing a small amount so as not to damage the objects in the stack 22. The narrow edge 230 is preferably straight but could be a shape which conforms to the stack's 22 desired perimeter. Standard cooking spatulas may be modified to function as aligners.

As the guide plate 148 moves up, the aligner actuator 58 rotates which causes the edge 230 of the spatulate aligner 42 to make contact with the stack edges 26. As the guide plate 148 moves down, the aligner actuator 58 rotates in the other direction which causes the edge 230 of the spatulate aligner 42 to move away from the stack edges 26.

The guide plate 148 continues the series of reciprocating motions up and down until the aligners 28, 30, 32, 34, 36, 38, 40, and 42 contact the stack edges 26 with a force great enough to constrict the stack 22 just past its nominal circumference (or perimeter, for stacks corresponding to other polygons). At this point the stack 22 is aligned into a uniform, concentric stack, and the guide plate 148 moves past the second aligner active track region 186 and stops the series of reciprocating up and down movements. Once the series of reciprocating up and down movements stops, the shuffle step is complete, and the guide plate 148 does not move for a short period.

During the short period that the guide plate 148 does not move, the aligner ball bearings 176 are positioned at the end of the second aligner active track region 186, and the finger ball bearings 208 are positioned at the end of the short intermediate finger active track region 218. Thus, when the shuffle step is complete and the guide plate 148 is stopped for the short period, the stack 22 remains encaged by the finger retainers 100, 102, 104, and 106, and the aligners 28, 30, 32, 34, 36, 38, 40, and 42 are in contact with the stack edges 26.

Figure 9:
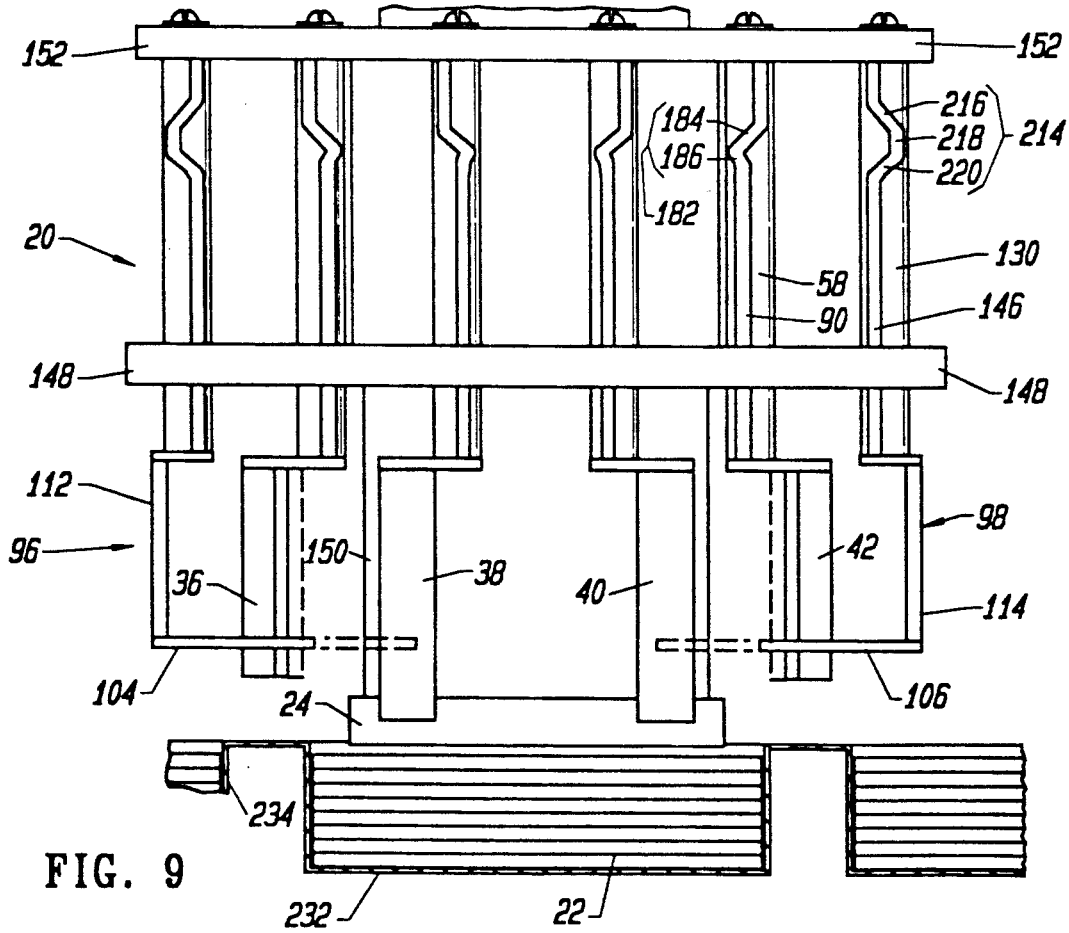
FIG. 9 is a side elevation view of the gripper assembly delivering a stack of objects to a container.

FIG. 9 illustrates the gripper assembly 20 delivering the aligned stack 22 to a rigid plastic container 232. When the gripper assembly 20 is used to deliver the stack 22 to the container 232, it is preferred to use a rotation assembly in order to rotate the gripper assembly 20 approximately 180° When the gripper assembly 20 is rotated 180°, the aligned stack 22 can be pushed into the container 232. The 180° rotation is called a "wrist rotation step," and pushing the stack 22 into the container 232 is called a "press to container step." An example of a rotation assembly will be discussed below with reference to FIG. 10.

During the wrist rotation step, which preferably occurs simultaneously with the shuffle step but may occur subsequent to the shuffle step, the gripper assembly 20 is rotated approximately 180° about a rotation axis. The rotation axis is parallel to the base plate 152 and positioned on the side of the base plate 152 opposite the guide plate 148. Furthermore, the rotation axis is perpendicular to an imaginary axis which is parallel to the longitudinal axis of the aligners 28, 30, 32, 34, 36, 38, 40, and 42 and which passes through the center of the stack 22.

The wrist rotation step preferably occurs simultaneously with the shuffle step because shuffling is aided by placing the stack 22 in a primarily stack edge 26 to earth orientation. This orientation decreases the surface frictional forces between the objects in the stack 22 which makes the objects more amenable to sliding into alignment. In other words, gravity tends to aid shuffling, rather than retard it through increased surface friction.

Because the wrist rotation step takes place during or immediately subsequent to the shuffle step, the stack 22 remains encaged by the finger retainers 100, 102, 104, and 106 and in contact with the aligners 28, 30, 32, 34, 36, 38, 40, and 42 during the wrist rotation step. Therefore, the alignment of the stack 22 will not be disturbed and the stack 22 will not fall out of the gripper assembly 20 when it is inverted (i.e., rotated 180 degrees).

FIG. 9 illustrates the gripper assembly 22 subsequent to the wrist rotation step and the press to container step. The rigid plastic container 232 is positioned beneath the gripper assembly 20 by a packaging station. When the container 232 is in place and the wrist rotation step is complete, the gripper assembly 20 begins the press to container step. The guide plate 148, whose movement was stopped for a short period after the shuffle step, starts moving again along the aligner actuators 44, 46, 48, 50, 52, 54, 56, and 58 and the finger actuators 124, 126, 128, and 130. This continued movement is now downward, rather than upward, since the gripper assembly 20 has been inverted.

As the guide plate 148 moves, the aligner ball bearings 176 move along the linear portion of the aligner actuator track 90 just past the second aligner active track region 186. Since this portion of the aligner actuator track 90 is linear and substantially parallel to the longitudinal axis of aligner actuator 58, the aligner 42 maintains its contact with the stack edges 26. The aligner 42, however, is not in contact with the stack edges 26 with maximum force at this point. The contact is with less force which enables the stack 22 to be pushed out of the gripper assembly 20 with relative ease.

Movement of the guide plate 148 causes the finger ball bearings 208 to move through the second finger active track regions 220, causing the finger retainers 100, 102, 104, and 106 to snap out of encaging position, i.e., move to the exterior of the polygon perimeter corresponding to the objects in the stack 22. Therefore, the stack 22 is no longer encaged.

After the finger retainers 100, 102, 104, and 106 move out of encaging position, the guide plate 148 continues movement along the aligner actuators 44, 46, 48, 50, 52, 54, 56, and 58 and the finger actuators 124, 126, 128, and 130. The elevator cap 24 and the elevator shaft 150, which are mounted on the guide plate 148, also move. The elevator cap 24, under the action of the stepper motor and screw mentioned above and discussed in detail below, presses the stack 22 into the container 232 at a rate faster than gravity.

The sequence of steps wherein the stack 22 is released by the finger retainers 100, 102, 104, and 106, and then is pressed into the container 232 by the elevator cap 24, occurs quickly. Thus, when the finger retainers 100, 102, 104, and 106 release the stack 22, the stack 22 will be pressed into the container 232 before gravity causes it to fall into the container 232. This speed insures that the stack 22 will be pressed into the container 232 straight and without causing the aligned, uniform stack 22 to become unaligned.

Immediately following the press to container step, the gripper assembly 20 begins a "return to accept step." During this step the guide plate 148 reverses it s movement and moves towards the base plate 152. When the elevator cap 24 is clear of the container 232, the packaging station advances another empty container 234 into receiving position.

The guide plate 148 continues to move towards the base plate 152 while the rotation assembly simultaneously rotates the gripper assembly 20 back to the accept position (i.e., up position). In the preferred embodiment, the rotation assembly rotates the gripper assembly 20 approximately 180° about the rotation axis in a direction opposite the direction rotated during the wrist rotation step. In other words, the gripper assembly 20 travels along the same 180° semicircle during both the wrist rotation and the return to accept rotation; the gripper assembly 20 never completes a 360° rotation. This reciprocating to and from rotation is preferable because it avoids commutation problems with the stepper motor wires were the gripper assembly 20 to rotate 360°.

In an alternative embodiment, if the commutation problems are solved by adapting the stepper motor wires for 360° rotation, the return to accept rotation may be a continuation of the wrist rotation step which would mean that the gripper assembly 20 is rotated 360°.

Whether it is rotated in the reverse 180° or forward 180°, the rotation returns the gripper assembly 20 to its accept position under the bomb bay conveyers 224. Because the guide plate 148 is pulled back against the base plate 152, the aligners 28, 30, 32, 34, 36, 38, 40, and 42 and the finger retainers 100, 102, 104, and 106 are withdrawn from the elevator cap 24, and thus, the gripper assembly 20 is ready to accept another unaligned stack.

Figure 10:
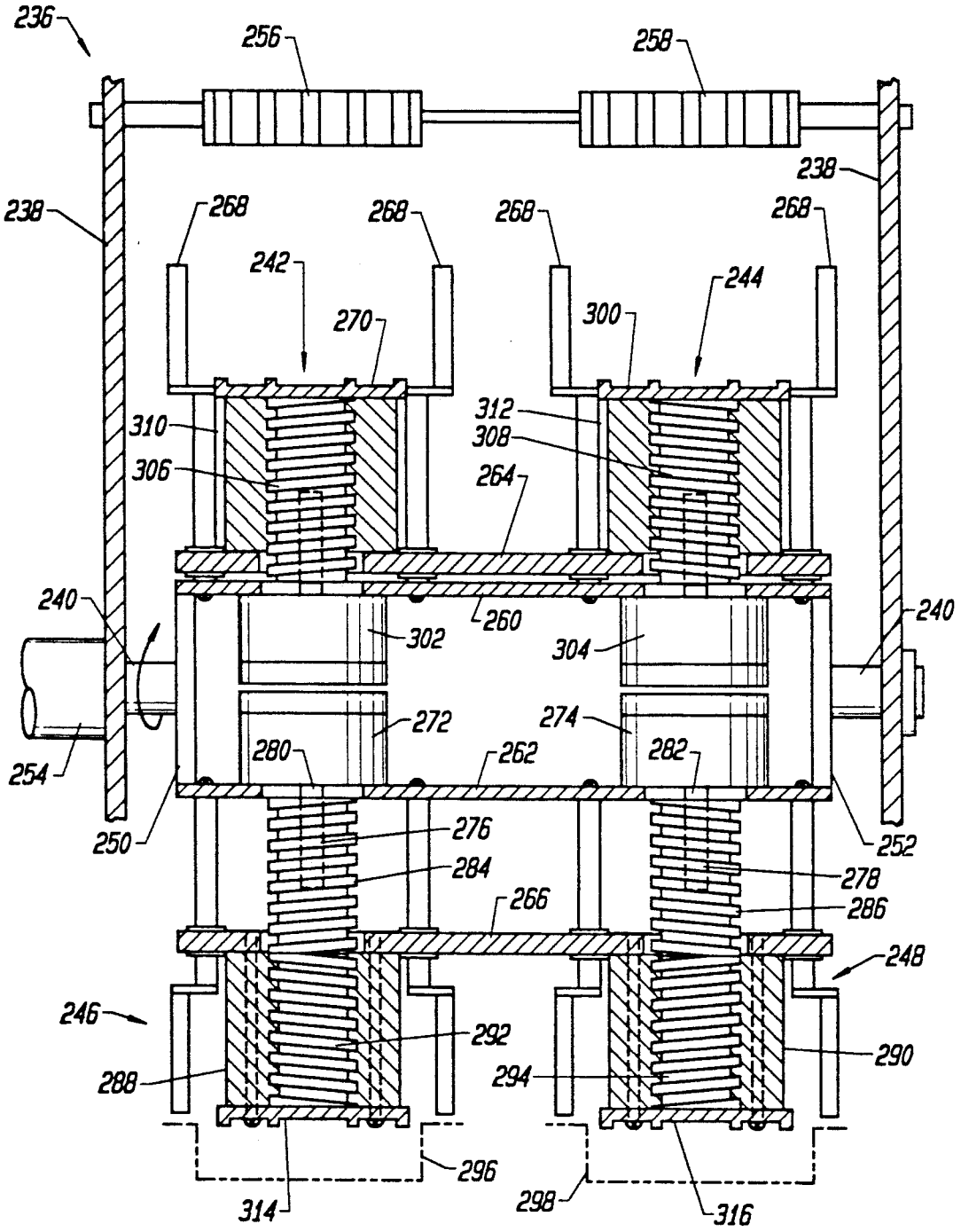
FIG. 10 is a longitudinal cross sectional view illustrating the elevator assemblies of four separate gripper assemblies.

FIG. 10 illustrates a preferred embodiment of a rotation assembly 236 in accordance with the present invention. A frame 238 rotatably fixes the ends of a two piece elongate rotation shaft 240. Two gripper assemblies 242 and 244 are disposed approximately 180° from two other gripper assemblies 246 and 248 about the axis of the two piece elongate rotation shaft 240. The gripper assemblies 242, 244, 246, and 248 are secured to the two piece elongate rotation shaft 240 by means of the supports 250 and 252. A rotation motor 254 rotates the two piece rotation shaft 240.

A packaging station provides two bomb bay assemblies 256 and 258 positioned above the gripper assemblies 242 and 244. The gripper assemblies 242 and 246 receive unaligned stacks from the same bomb bay assembly 256, and the gripper assemblies 244 and 248 receive unaligned stacks from the same bomb bay assembly 258. Thus, the gripper assemblies 242 and 246 should be designed to receive, align, and deliver the same size and same shape stack of objects. Similarly, the gripper assemblies 244 and 248 should be designed for the same size and same shape stack of objects. The two sets of gripper assemblies 242, 246 and 244, 248, however, may be designed to receive, align, and deliver differently sized and shaped stacks of objects. This would require that the bomb bay assembly 256 deliver one type of stack, and the bomb bay assembly 258 deliver a different type of stack.

The axis of the elongate rotation shaft 240 is collinear to the rotation axis described above: the axis of the elongate rotation shaft 240 is parallel to the base plates 260 and 262 and located on the opposite sides of the base plates 260 and 262 from the guide plates 264 and 266. The axis of the elongate rotation shaft 240 is positioned perpendicular to an imaginary axis that is parallel to the longitudinal axis of the aligners 268 and which passes through the center of the elevator cap 270.

FIG. 10 also illustrates the preferred structure for moving the guide plates 266 and 264 relative to the base plates 260 and 262. The stepper motors 272 and 274 are mounted to the base plate 262 on the opposite side from the guide plate 266. Stepper motor shafts 276 and 278 extend through the apertures 280 and 282 in the base plate 262. Elevator screws 284 and 286 are collinearly mounted on the stepper motor shafts 276 and 278. The elevator shafts 288 and 290 have internally threaded cavities 292 and 294 sized for receiving the elevator screws 284 and 286 therein.

Rotation of the stepper motor shafts 276 and 278 causes the elevator screws 284 and 286 to rotate into, and out of, the threaded cavities 292 and 294 of the elevator shafts 288 and 290. This rotation results in the elevator shafts 288 and 290 moving up and down relative to the stepper motors 272 and 274. Because the elevator shafts 288 and 290 are fastened to the guide plate 266, and the stepper motors 272 and 274 are fastened to the base plate 262, movement of the elevator shafts 288 and 290 relative to the stepper motors 272 and 274 causes movement of the guide plate 266 relative to the base plate 262.

The rotation assembly 236 can be advantageously used in conjunction with a packaging station. According to the embodiment shown in FIG. 10, the bomb bay assemblies 256 and 258 are mounted at the top of the frame 238. Containers 296 and 298 for receiving aligned stacks are positioned at the bottom of the rotation assembly 236.

The operation of the rotation assembly 236 is described with reference to FIG. 10. The upper gripper assemblies 242 and 244 are initially in the accept position. The bomb bay assemblies 256 and 258 drop unaligned stacks onto the elevator caps 270 and 300. The gripper assemblies 242 and 244 then start the alignment and deliver cycle. The first step of the alignment and deliver cycle is the grasp and constrain step. The stepper motors 302 and 304 turn the elevator screws 306 and 308 clockwise a short distance. Because the elevator shafts 310 and 312 are fastened to the guide plate 264, rotation of the elevator screws 306 and 308 causes the guide plate 264 to raise through the first finger active track regions of the finger actuator tracks. The finger retainers (not visible in FIG. 10) extend into the interior of the polygon perimeter of the stacks of objects and encage the stacks.

The gripper assemblies 242 and 244 next enter the shuffle step. This results from the stepper motors 302 and 304 continuing clockwise rotation of the elevator screws 306 and 308. The guide plate 264 raises through the first aligner active track region of the aligner actuator tracks. The aligners 268 rotate and make contact with the polygon perimeter of the objects in the stacks. The stepper motors 302 and 304 then reverse the direction of rotation of the elevator screws 306 and 308. This counterclockwise rotation causes the guide plate 264 to reverse its direction of movement and move through the first aligner active track region in the other direction. This rotates the aligners 268 away from the polygon perimeter of the objects in the stack.

The stepper motors 302 and 304 rotate their shafts through a series of short reciprocating clockwise and counterclockwise rotations, causing the guide plate 264 to make reciprocating up and down movements, as discussed above, and specifically illustrated by the arrows 154 in FIG. 1. On each clockwise rotation the stepper motors 302 and 304 rotate the elevator screws 306 and 308 a little farther than the last clockwise rotation. This increased amount of clockwise rotation causes the guide plate 264 to move up a little farther into the first aligner active track regions of the aligner actuator tracks on each upward movement. This causes the aligners 268 to contact the stack perimeter with a little more force on each upward movement of the guide plate 264. The reciprocating up and down movements of the guide plate 264 are continued until the aligners 268 contact the stack edges with enough force to constrict the stacks just past their nominal circumferences. The guide plate 264 then moves through the second aligner active track regions causing the aligners 268 to rotate away from the stack perimeters a small amount; the aligners, however, remain in light contact with the stack perimeters. At this point the guide plate 264 stops movement for a short period, and the shuffle step is complete. The stacks remain encaged by the finger retainers, and the aligners are positioned against the stack edges.

The wrist rotation step takes place simultaneously with the shuffle step. While the guide plate 264 is in the series of reciprocating up and down movements, the rotation motor 254 rotates the two piece elongate rotation shaft 240 approximately 180°. This rotation inverts the gripper assemblies 242 and 244 and positions them above the two empty containers 296 and 298. The 180° rotation also rotates the gripper assemblies 246 and 248 into the accept position beneath the bomb bay conveyers 256 and 258.

Once positioned above the empty containers 296 and 298, the gripper assemblies 242 and 244 begin the press to container step. The guide plate 264, which was stopped for a short period after the shuffle step, starts its movement again in a direction away from the base plate 260. This movement causes the finger retainers to move out of encaging position. The guide plate 264 continues to move which results in the elevator caps 270 and 300 pressing the stacks into the containers 296 and 298.

After the press to container step is complete, the gripper assemblies 242 and 244 begin the return to accept step. The stepper motors 302 and 304 rotate the elevator screws 306 and 308 counterclockwise which moves the guide plate 264 back towards the base plate 260. When the elevator caps 270 and 300 are clear of the containers 296 and 298, the packaging station positions two empty containers beneath the rotation assembly 236. The gripper assemblies 242 and 244 are ready to be rotated about the elongate rotation shaft 240 back to the accept position.

While the gripper assemblies 242 and 244 are in the press to container step, the other gripper assemblies 246 and 248 are in the accept position and ready for the bomb bay conveyers 256 and 258 to drop unaligned stacks onto their elevator caps 314 and 316. When the gripper assemblies 242 and 244 begin the return to accept step, the gripper assemblies 246 and 248 simultaneously begin the grasp and constrain step. The gripper assemblies 246 and 248 then enter the shuffle step and wrist rotation step simultaneously. The wrist rotation step positions the gripper assemblies 246 and 248 for the press to container step; this same wrist rotation step completes the return to accept cycle for the gripper assemblies 242 and 244. Thus, using the rotation assembly 236, two alignment and deliver cycles take place simultaneously. In other words, while the gripper assemblies 246 and 248 deliver aligned stacks to the containers 296 and 298, the other gripper assemblies 242 and 244 receive unaligned stacks.

During the wrist rotation step and the return to accept step, the rotation motor 254 may rotate the elongate rotation shaft 240 only in one direction; in this situation the gripper assemblies 242 and 244 complete a 360° rotation after completing both the wrist rotation and the return to accept rotation. In the preferred embodiment described here, however, the rotation motor 254 rotates the elongate rotation shaft 240 in opposite directions for wrist rotation and return to accept rotation; in this situation the gripper assemblies 242 and 244 rotate 180° for wrist rotation and then reverse direction and rotate back over that same 180° for the return to accept rotation.

The rotation assembly 236 can be easily adapted to accommodate any number of gripper assemblies. The number of gripper assemblies actually used on the rotation assembly 236 will vary depending upon the configuration of the packaging station used. Furthermore, whether or not there are two or more gripper assemblies disposed 180° from each other also depends on the packaging station used. The embodiment of the rotation assembly 236 shown in FIG. 10 is designed to function with common packaging station configurations.

In this preferred embodiment, the stepper motors 272, 274, 302, and 304 are enhanced permanent magnet DC stepper motors which allow the highest possible torque for a given motor size. A high torque enables the motors to perform their rotation instructions (discussed below) very fast and have greater strength in performing the gripping tasks. Servo motors of many varieties may be used, but stepper motors offer good torque and speed characteristics in a relatively simple and inexpensive package. In the preferred embodiment, the torque for the stepper motors 272, 274, 302, and 304 should be about 750 oz.-in., and the torque for the rotation motor 254 should be about 3000 oz-in. These ratings enable the motors to properly perform the tasks described above.

The basic operation of the stepper motor 302 is now described. The permanent magnet DC stepper motor is one of the key motor types used in precision motion control. It is composed of a permanent magnet rotor and a set of wound stator coils. As the stator coils are energized, an electric field is produced which interacts with the magnetic field of the rotor. Depending on the direction of current flow through the stator windings, the polarity of the electric field is determined. If left unconstrained by some type of external mechanism (e.g., a brake, or a load beyond the capacity of the motor) the rotor will seek its equilibrium position, with opposing polarities of the electric and magnetic fields aligning with each other. By changing the direction of the current through one of the stator windings, a new equilibrium position is defined. The rotor will move to this new position at a speed defined by the fundamental relationship of the friction and inertia (load) of the rotor and any attached mechanism, and the torque developed by the interaction of the rotor and stator fields. When the rotor moves to this new position, the motor is said to have "stepped."

With an understanding of the stepper motor movement, it can be seen that by changing the stator winding currents in an orderly fashion, any acceleration, deceleration, or running speed can be obtained, within the constraints of the torque which can be developed at the rotor through the predefined field interactions, the inertial and frictional nature of the load, and the charge time equations for the stator windings. This final parameter is one of the primary factors which sets the maximum possible speed for any given stepper motor system. Also, for any given stepper motor with a fixed number of poles, there is a fixed number of steps per rotation of the motor. This allows the motor not only to produce any given motion profile in a properly designed system, but to achieve a precise given position with a final accuracy determined by the tolerance of construction of the motor, typically less than 5% of one step (with 200 steps per revolution being typical of many motors).

In the preferred embodiment of this invention, a microprocessor controller issues rotation instructions to the stepper motors 272, 274, 302, and 304, and the rotation motor 254. This microprocessor controller is preprogrammed to issue the proper rotation instructions to the appropriate motors at the appropriate times in order to insure that all of the steps of the alignment and delivery cycles of the gripper assemblies 246, 248, 242, and 244 are executed in the proper sequence. The rotation instructions indicate to the stepper motors the number of rotations to make.

In the gripper assembly 242, a magnetic reed switch is placed within the cavity housing the stepper motor 302 and affixed to the base plate 260. A magnet is affixed to the guide plate 264 so that when the magnet is in close proximity to the reed switch, the reed switch is made. On power up, the microprocessor controller initializes the gripper assembly 242 by interrogating the reed switch. If the switch is made, the gripper assembly 242 is said to be in accept position, if not, the controller issues counter clockwise step commands to the stepper motor 302, causing the guide plate 264 to retract toward the stepper motor 302, until the switch is made. Simultaneously, the controller initializes the rotation motor 254, which is discussed separately in a section which follows this discussion.

The controller begins a cycle with the gripper assembly 242 in the accept position, as defined above. This places the aligners and fingers in the accept position. The controller awaits a signal that a stack from the slicer has come into position on the bomb bay conveyor 256, by contacting its bomb bay backstop. The mechanism for detecting this position and delivering this signal may be a sensor at the contact point of the bomb bay backstop. At this time, the controller issues a signal for the bomb bay conveyor 256 to cease its conveying movement, and the surface comes to rest. In the opposing gripper assembly 246, the entire system would now rest and await a signal from the packaging station that an empty package had arrived (discussed below).

In a single gripper assembly scheme, i.e., if the gripper assembly 242 were the only gripper assembly on the rotation assembly 236, the controller would next signal the bomb bay conveyor to open, by activating the open direction pneumatic actuators. The controller delays the amount of time, defined by gravity, for the group to freefall into the confines of the gripper assembly, coming to rest on the elevator cap 270. Immediately, the stepper motor 302 begins a clockwise (CW) rotation, as quickly as is permitted by the movement parameters of the system, to encage and confine the stack within the gripper assembly. This initial stepper motor 302 movement is referred to as "the grasp and constrain" step. The rotation motor 254 immediately begins to rotate as discussed below. The stepper motor 302 continues to rotate CW, raising the guide plate 264 and the aligner bearing assemblies into the active area of the aligner actuators.

The following gripper assembly 242 movement is called "the shuffle" step. In the preferred embodiment, approximately three-quarters of a full rotation of the stepper motor 302 raises the guide plate 264 completely through the full aligner active track region. In this embodiment, the stepper motor 302 continues the initial CW rotation for three-eighths of a rotation into the aligner active track region. The stepper motor 302 next immediately reverses its direction and rotates counterclockwise (CCW) for one-quarter of a rotation. This is followed by another three-eighths rotation CW, then one-quarter CCW, then three-eighths CW, followed by a last one-quarter CCW rotation, and a final three-eighths CW which brings the guide plate 264 to the end of the first aligner active track region. The aligners are in contact with the stack edges with maximum force, and the shuffle step is nearly complete.

The aligner position is at the apex of the grasp, which is actually somewhat smaller than the tolerance needed to place the stack in the container. The coordination of this movement with the wrist rotation step optimizes performance. Preferably, the elongate rotation shaft 240 should at this point have just completed the rotation, inverting the stack within the gripper assembly 242 above the packaging station.

The stepper motor 302 continues moving CW, moving the guide plate 264 through the second aligner active track region of the aligner actuator track, whose gradient is now opposite to the gradient of the first aligner active track region. During the next one-eighth of a rotation, the guide plate 264 traverses this track completely, causing the aligners to just slightly relax their grip on the stack. The stepper motor 302 continues to rotate CW, with no action by either finger or aligner actuators for a preprogrammed distance. As it is intended for the gripper assembly 242 to handle varying stack heights, it is necessary for the elevator cap 270 to continue to move rapidly outward to constrain the stack in a volume which is just taller than the nominal height of the intended package. This movement leaves the finger bearing assemblies in the short intermediate finger active track regions just prior to their second finger active track region. When this last motion is complete, the stack rests on the inverted fingers, with the elevator cap 270 just out of contact with it, and the aligners lightly touching the stack edges.

The stepper motor 302 stops, which stops the movement of the guide plate 264, and the controller and the system remain at rest pending a signal from the packaging station that an empty container has come to rest in the registered position directly under the inverted gripper assembly 242.

When the packaging station fulfills this criterion, the stepper motor 302, on reception of the signal, begins a final, long (three rotations typical) CW rotation, at a rate which moves the guide plate 264 faster than gravity in the downward direction. During the first one-eighth rotation of the stepper motor 302, the guide plate 264 enters the second finger active track region, causing the fingers to rapidly snap open beyond the package perimeter. The aligner actuator tracks are here parallel to the direction of guide plate 264 movement, and so do not move, but instead serve to constrain the stack on its final movement into the container. The elevator cap 270 presses the container from the gripper assembly volume into the container volume, coming to rest only after the elevator cap 270 has descended just below the rim of the container volume (within an allowable tolerance). This last three rotation movement is called the "press to container" step.

The stepper motor 302 immediately reverses rotation (CCW) and moves the guide plate 264 back beyond the confines of the container. This rotation continues as rapidly as possible until the gripper assembly returns to the accept position. This last movement is called the "return to accept" step. The completion of this movement returns the gripper assembly to the accept position.

The controller also commands the movement of the rotation motor 254. This motor can be either a servo or a stepper motor, as with the gripper assembly. Again, a reed switch or suitable encoder device is used to indicate that the wrist is in its home position, which is to say that the gripper assembly 242 is at the accept position, directly under the bomb bay conveyor 256 position. After the gripper assembly has grasped the stack, the controller instructs the rotation motor 254 to begin a 180° rotation of the rotation shaft 240 (CW or CCW, the initial direction is not important, bring the gripper assembly 242 to the accept position above the package location, as described above. Simultaneously, the gripper assembly 242 performs its shuffle step, as described above. Following the press to container and the initial retraction of the elevator cap 270 from the confines of the container, the rotation motor 254, in a single gripper assembly system, immediately counter-rotates (opposite to the initial rotation, for commutation purposes) the gripper assembly 242 back to the accept position. Simultaneously, the stepper motor 302 is performing its complete retract, leaving it also in the home or accept position.

In a two or opposing gripper assembly system, the wrist rotation moves only 180 degrees per cycle, reversing its rotation for each cycle performed.

It should be understood that various alternatives to the embodiments of the invention described herein may be employed in practicing the invention. It is intended that the following claims define the scope of the invention and that structures and methods within the scope of these claims and their equivalents be covered thereby.

What is claimed is:

1. A stack loading apparatus for aligning stacks of similarly shaped sheet-like objects, said stack loading apparatus comprising:

means for surrounding a perimeter of an unaligned stack of similarly shaped sheet-like objects with a plurality of elongate spatulate aligner members, said aligner members positioned in close proximity to said unaligned stack to permit contact between said unaligned stack and said aligned members, said aligner members positioned substantially perpendicular to a sheet-like surface of an object in said unaligned stack; and means for reciprocatingly rotating said aligner members back and forth about axes parallel to their longitudinal axes;

wherein the rotation of said aligner members contacting said unaligned stack causes an aligned stack of similarly shaped sheet-like objects to form.

2. The stack loading apparatus of claim 1, further comprising:

means for elevating and lowering said unaligned stack relative to said perimeter surrounding means in a direction parallel to said aligner member longitudinal axis.

3. The stack loading apparatus of claim 2, further comprising:

means for supporting said unaligned stack in an orientation wherein said sheet-like surface of said object is perpendicular to said aligner longitudinal axis;

means for surrounding said perimeter with a plurality of elongate finger members, each finger member having a retainer member which selectively extends into, and out of, the interior of said perimeter, said retainer members lying in a plane parallel to said sheet-like surface of said object; and second rotation means for rotating said unaligned stack, said aligner member surrounding means, said finger member surrounding means, and said stack supporting means approximately 180 degrees about a rotation axis positioned below said stack supporting means, said rotation axis lying in a plane parallel to said sheet-like surface of said object, and said rotation axis is perpendicular to a second axis extending through the center of said unaligned stack and parallel to said aligner member longitudinal axis;

wherein said stack loading apparatus is adapted to receive said unaligned stack within said aligner member surrounding means, to support said unaligned stack on said stack supporting means, to encage said unaligned stack by selectively extending said retainer members into the interior of said perimeter above said unaligned stack, to align said unaligned stack into said aligned stack through the interaction of said unaligned stack with said aligner member surrounding means, said finger member surrounding means and said stack supporting means, and to deliver said aligned stack to a container located one hundred eighty degrees around said rotation axis from said stack-receiving position by the interaction of said second rotation means, said stack supporting means and said finger member surrounding means wherein said retainer members are selectively extended out of said perimeter.

4. A stack loading apparatus for receiving and aligning stacks of similarly shaped sheet-like objects, said stack loading apparatus comprising:

a base plate adapted to rotatably fix aligner actuator ends;

a plurality of elongate aligner actuators each having a first end, a second end, and an outer surface, said aligner actuator first end being rotatably fixed to said base plate to permit rotation of said aligner actuator about its longitudinal axis which is positioned perpendicular to said base plate, said plurality of aligner actuators arranged on said base plate about a polygon perimeter corresponding to said sheet-like object perimeter, and said aligner actuators each having an aligner actuator track disposed on its outer surface;

a movable guide plate, positioned substantially parallel to said base plate, having a plurality of aligner actuator-receiving apertures which apertures are defined by an inner perimeter sized for receiving said aligner actuators, said aligner actuator-receiving apertures having a ball bearing rotatably mounted on said inner perimeter for engaging said aligner actuator tracks;

a plurality of elongate aligners, each aligner fastened at one end to said aligner actuator second end, each elongate aligner corresponding to an aligner actuator;

means, disposed on said guide plate substantially at the center of said aligner actuator polygon, for supporting an unaligned stack of similarly shaped sheet-like objects in an orientation substantially parallel to said guide plate; and means for moving said guide plate relative to said base plate along said aligner actuator longitudinal axis while maintaining said plates in substantially parallel relationship;

wherein, said moving means causes said guide plate to move relative to said base plate which causes said aligner actuators to rotate about their longitudinal axes which causes said aligners to contact and to act upon said unaligned stack to obtain an aligned stack of similarly shaped sheet-like objects.

5. The stack loading apparatus of claim 4, wherein said stack supporting means comprises:

a cylindrical elevator shaft having a first open end mounted to said guide plate; and a substantially planar elevator cap mounted to close the second end of said elevator shaft.

6. The stack loading apparatus of claim 5, wherein said elevator shaft has an internally threaded cavity and wherein said guide plate has an elevator screw aperture to provide access to said internally threaded cavity of said elevator shaft from the base plate side of said guide plate, and wherein said moving means comprises:

a stepper motor mounted to said base plate on a side opposite said guide plate, said stepper motor having a shaft which extends through a shaft aperture in said base plate; and an elevator screw mounted collinearly on said stepper motor shaft and adapted to extent through said guide plate elevator screw aperture and to engage with said elevator shaft cavity;

wherein, rotation of said stepper motor shaft causes said elevator screw to rotate and engage with said elevator shaft cavity which causes said elevator shaft and guide plate to move relative to said base plate.

7. The stack loading apparatus of claim 4, wherein said base plate is adapted to rotatably fix finger actuator ends, and wherein said guide plate has a plurality of finger actuator-receiving apertures which apertures are defined by an inner perimeter sized for receiving finger actuators, said finger actuator-receiving apertures having a ball bearing rotatably mounted on said inner perimeter; said stack loading apparatus further comprising:

a plurality of elongate finger actuators each having a first end, a second end, and an outer surface, said finger actuator first end being rotatably fixed to said base plate to permit rotation of said finger actuator about its longitudinal axis which is positioned perpendicular to said base plate, said plurality of finger actuators arranged on said base plate at least as far from the center of said polygon as said aligner actuators, and said finger actuators each having a finger actuator track disposed on its outer surface; and a plurality of fingers, each finger having an elongate finger shaft fastened at one end to a corresponding finger actuator and a finger retainer member attached to said finger shaft other end, said finger retainer members lying in a plane parallel to said base plate and perpendicular to said finger shaft, said finger retainer members adapted to selectively extend into, and out of, the interior of said polygon defined by said aligner actuators;

wherein, movement of said guide plate relative to said base plate causes said finger actuators to rotate about their longitudinal axes which causes said finger retainer members to selectively extend into the polygon interior and above said unaligned stack, thereby causing said unaligned stack to become encaged between said finger retainer members, said stack supporting means, and said aligners.

8. The stack loading apparatus of claim 7, further comprising:

a rotation assembly means for rotating said base plate about a rotation axis below said base plate, parallel to said base plate, and said rotation axis is perpendicular to a second axis which is parallel to said aligner actuator longitudinal axis and which passes through the center of said aligner actuator polygon.

9. The stack loading apparatus of claim 8, wherein said rotation assembly means comprises:

an elongate rotation shaft;

means for securing said base plate to said rotation shaft; and frame means for rotatably fixing the ends of said rotation shaft;

wherein, rotation of said rotation shaft causes said base plate to rotate about said rotation axis.

10. The stack loading apparatus of claim 9, wherein said rotation assembly means further comprises:

a motor, mounted on said frame means and coupled to said rotation shaft, for driving the rotation of said rotation shaft.

11. The stack loading apparatus of claim 10, wherein said stack loading apparatus has a first position for receiving said unaligned stack and a second position for delivering said aligned stack to a container, and wherein rotation of said rotation shaft about 180 degrees from said first position causes said stack loading apparatus to switch from said first position to said second position, and wherein a second rotation of said rotation shaft about 180 degrees causes said stack loading apparatus to move from said second position to said first position.

12. A stack loading device for receiving, aligning, and delivering stacks of similarly shaped sheet-like objects to containers, said stack loading device comprising:

an elongate rotation shaft;

frame means for rotatably fixing the ends of said rotation shaft; and at least two gripper assemblies that each have a plurality of reciprocatingly rotating elongate aligners that rotate about axes parallel to their longitudinal axes for receiving and aligning stacks of similarly shaped sheet-like objects, said gripper assemblies supported on said rotation shaft;

wherein pairs of said gripper assemblies are disposed from each other approximately 180 degrees around said rotation shaft; and wherein, during operation of said device, while one member of said gripper assembly pair receives an unaligned stack of similarly shaped sheet-like objects, the other member of said gripper assembly pair delivers an aligned stack of similarly shaped sheet-like objects to said container.

13. The stack loading apparatus of claim 12, wherein said gripper assemblies each comprise:

a base plate adapted to rotatably fix aligner actuator ends;

a plurality of elongate aligner actuators each having a first end, a second end, and an outer surface, said aligner actuator first end being rotatably fixed to said base plate to permit rotation of said aligner actuator about its longitudinal axis which is positioned perpendicular to said base plate, said plurality arranged on said base plate about a polygon perimeter corresponding to said sheet-like objects perimeter, said aligner actuators each having an aligner actuator track disposed on its outer surface, and each of said elongate aligners being fastened to one of said aligner actuators second end;

a movable guide plate, positioned substantially parallel to said base plate, having a plurality of aligner actuator-receiving apertures which apertures are defined by an inner perimeter sized for receiving said aligner actuators, said aligner actuator-receiving apertures having a ball bearing rotatably mounted on said inner perimeter for engaging said aligner actuator tracks;

means, disposed on said guide plate substantially at the center of said aligner actuator polygon, for supporting said unaligned stack in an orientation substantially parallel to said guide plate; and means for moving said guide plate relative to said base plate along said aligner actuator longitudinal axis while maintaining said plates in substantially parallel relationship;

wherein, said moving means causes said guide plate to move relative to said base plate which causes said aligner actuators to rotate about their longitudinal axes which causes said aligners to contact and to act upon said unaligned stack to obtain said aligned stack.

14. The stack loading apparatus of claim 13, wherein said base plate of each gripper assembly is adapted to rotatably fix finger actuator ends, and wherein said guide plate of each gripper assembly has a plurality of finger actuator-receiving apertures which apertures are defined by an inner perimeter sized for receiving finger actuators, said finger actuator-receiving apertures having a ball bearing rotatably mounted on said inner perimeter;

said gripper assemblies each further comprising:

a plurality of elongate finger actuators each having a first end, a second end, and an outer surface, said finger actuator first end being rotatably fixed to said base plate to permit rotation of said finger actuator about its longitudinal axis which is positioned perpendicular to said base plate, said plurality of finger actuators arranged on said base plate at least as far from the center of said polygon as said aligner actuators, and said finger actuators each having a finger actuator track disposed on its outer surface; and a plurality of fingers, each finger having an elongate finger shaft fastened at one end to a corresponding finger actuator and a finger retainer member attached to said finger shaft other end, said finger retainer members lying in a plane parallel to said base plate and perpendicular to said finger shaft, said finger retainer members adapted to selectively extend into, and out of, the polygon interior defined by said aligner actuators;

wherein, movement of said guide plate relative to said base plate causes said finger actuators to rotate about their longitudinal axes which causes said finger retainer members to selectively extend into the polygon interior and above said unaligned stack, thereby causing said unaligned stack to become encaged between said finger retainer members, said stack supporting means, and said aligners.

15. A method of receiving, aligning, and delivering stacks of similarly shaped sheet-like objects to containers, said method comprising the steps of:

a) providing a stack loading apparatus with accept and deliver positions and an alignment and deliver cycle having (i) a grasp and constrain step, (ii) a shuffle step, (iii) a wrist rotation step, and (iv) a press to container step, said stack-loading apparatus having a gripper assembly coupled to an elongate rotation shaft which shaft is supported at each end by a frame member, said gripper assembly having a plurality of selectively extendable fingers for assisting in encaging an unaligned stack of similarly shaped sheet-like objects and a plurality of aligners for aligning and encaging said unaligned stack, said gripper assembly having means for reciprocatingly rotating said fingers and said aligners about axes parallel to their longitudinal axes, whereby said aligners contact and align said unaligned stack into an aligned stack of similarly shaped sheet-like objects;

b) providing a packaging station having means for loading said unaligned stack into said gripper assembly and having means for positioning a container to receive said aligned stack from said gripper assembly;

c) delivering said unaligned stack to said gripper assembly at said packaging station while said stack loading apparatus is in its accept position;

d) operating said stack loading apparatus through said grasp and constrain step wherein said gripper assembly fingers and aligners encage said unaligned stack;

e) operating said stack loading apparatus through said shuffle step wherein said aligners reciprocatingly rotate causing said aligners to contact and to align said unaligned stack into said aligned stack;

f) operating said stack loading apparatus through said wrist rotation step wherein said rotation shaft rotates approximately 180 degrees causing said gripper assembly to rotate approximately 180 degrees from the accept position; and g) operating said stack loading apparatus through said press to container step wherein said gripper assembly delivers said aligned stack to said container without disrupting alignment of said aligned stack.

16. The method of claim 15, wherein said means for rotating said fingers and said aligners of said gripper assembly of said step (a) comprises:

a base plate adapted to rotatably fix said elongate fingers and said elongate aligners, said fingers and said aligners each positioned such that its longitudinal axis is perpendicular to said base plate;

a movable guide plate, positioned substantially parallel to said base plate, having a plurality of apertures for receiving said fingers and said aligners, said apertures each having a bearing means for engaging with a track on the surface of each of said fingers and said aligners, said track adapted to cooperate with said bearing means to cause said fingers and said aligners to reciprocatingly rotate about their longitudinal axes, said guide plate having an elevator screw aperture for providing access to an elevator screw;

a cylindrical elevator shaft having one open end mounted to said guide plate, said elevator shaft having an internally threaded cavity in alignment with said guide plate elevator screw aperture;

a substantially planar elevator cap mounted to close the second end of said elevator shaft;

a stepper motor mounted to said base plate on a side opposite said guide plate, said stepper motor having a shaft which extends through a shaft aperture in said base plate; and an elevator screw mounted collinearly on said stepper motor shaft and adapted to extend through said guide plate elevator screw aperture and to engage with said elevator shaft cavity;

wherein, rotation of said stepper motor shaft of said stepper motor causes said elevator screw to rotate and to engage with said elevator shaft cavity which causes said elevator shaft and guide plate to move relative to said base plate.

17. A method of aligning stacks of similarly shaped sheet-like objects, said method comprising the steps of:

a) surrounding a perimeter of an unaligned stack of similarly shaped sheet-like objects with a plurality of elongate spatulate aligner members, said aligner members positioned in close proximity to said unaligned stack to permit contact between said unaligned stack and said aligner members, said aligner members positioned substantially perpendicular to a sheet-like surface of an object in said unaligned stack; and b) reciprocatingly rotating said aligner members back and forth about axes parallel to their longitudinal axes, wherein said aligner members act upon and align said unaligned stack to obtain an aligned stack of similarly shaped sheet-like objects.

18. The method of claim 17, further comprising the step of:

c) elevating and lowering said unaligned stack along said aligner members longitudinal axes.

19. The method of claim 18, further comprising the steps of:

d) supporting said unaligned stack on a substantially planar elevator cap member;

e) surrounding said perimeter with a plurality of elongate finger members each having a retainer member which selectively extends into, and out of, the interior of said perimeter, said retainer members lying in a plane parallel to said sheet-like surface of said object, whereby, said aligners, said elevator cap member, and said retainer members encage said unaligned stack;

f) rotating said unaligned stack, said aligners, said fingers, and said elevator cap member approximately 180 degrees about a rotation axis positioned on said elevator cap member side opposite to said unaligned stack, said rotation axis lying in a plane parallel to said sheet-like surface of said object and said rotational axis is perpendicular to a second axis extending through the center of said unaligned stack and parallel to said aligners longitudinal axes;

g) rotating said fingers so that said finger retainer members withdraw from said perimeter interior after said unaligned stack is aligned into said aligned stack, wherein said aligned stack is not encaged in one direction of said aligners longitudinal axes; and h) moving said elevator cap member in a direction perpendicular to said sheet-like surface of said object, wherein said aligned stack is delivered to a container.

* * * * *